US011691835B2

(12) United States Patent
Seto et al.

(10) Patent No.: US 11,691,835 B2
(45) Date of Patent: Jul. 4, 2023

(54) CONVEYING DEVICE, LIQUID APPLYING APPARATUS, IMAGE FORMING APPARATUS, AND POST-PROCESSING APPARATUS

(71) Applicants: Takashi Seto, Kanagawa (JP); Takamasa Hase, Tokyo (JP)

(72) Inventors: Takashi Seto, Kanagawa (JP); Takamasa Hase, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 275 days.

(21) Appl. No.: 17/148,569

(22) Filed: Jan. 14, 2021

(65) Prior Publication Data

US 2021/0214178 A1 Jul. 15, 2021

(30) Foreign Application Priority Data

Jan. 15, 2020 (JP) ..... 2020-004285

(51) Int. Cl.

| | |
|---|---|
| ***B65H 7/06*** | (2006.01) |
| ***B65H 9/16*** | (2006.01) |
| ***B41J 13/00*** | (2006.01) |
| ***B41J 13/02*** | (2006.01) |
| ***B41J 13/076*** | (2006.01) |

(52) U.S. Cl.

CPC ..... *B65H 9/166* (2013.01); *B41J 13/0009* (2013.01); *B41J 13/025* (2013.01); *B41J 13/076* (2013.01); *B65H 2404/1416* (2013.01); *B65H 2404/1521* (2013.01); *B65H 2801/06* (2013.01)

(58) Field of Classification Search

CPC ..... B65H 2301/51256; B65H 9/166; B65H 5/062; B65H 7/06; B65H 43/04; B65H 85/00; B65H 29/70; B41J 13/0009; B41J 13/025; B41J 13/076

See application file for complete search history.

(56) References Cited

U.S. PATENT DOCUMENTS

| | | | | |
|---|---|---|---|---|
| 5,183,454 A * | 2/1993 | Kurosawa | B65H 5/062 493/459 |
| 5,519,481 A * | 5/1996 | Kuo | G03G 15/6576 399/45 |
| 6,259,888 B1 * | 7/2001 | Kazama | B65H 29/12 271/183 |

(Continued)

FOREIGN PATENT DOCUMENTS

| | | |
|---|---|---|
| JP | 2001-261221 | 9/2001 |
| JP | 2012240778 A * | 12/2012 |

*Primary Examiner* — Patrick H Mackey

(74) *Attorney, Agent, or Firm* — Xsensus LLP

(57) ABSTRACT

A conveying device includes a pair of rotary bodies and a movable member. The pair or rotary bodies includes a first rotary body disposed in a first region, and a second rotary body disposed in a second region and facing the first rotary body across a sheet conveyance passage through which a sheet applied with liquid is conveyed. The movable member is disposed upstream from the first rotary body in a sheet conveyance direction. The movable member is configured to move between the first region and the second region with respect to the sheet conveyance passage. The movable member is configured to move to the second region in a middle of conveyance of the sheet between the first rotary body and the second rotary body.

20 Claims, 18 Drawing Sheets

(56) References Cited

U.S. PATENT DOCUMENTS

| | | | | |
|---|---|---|---|---|
| 6,473,592 | B2 * | 10/2002 | Nishio | B65H 29/12 399/406 |
| 10,865,066 | B2 * | 12/2020 | Hayashi | B65H 29/125 |
| 2002/0051665 | A1 | 5/2002 | Seto et al. | |
| 2003/0129008 | A1 | 7/2003 | Seto | |
| 2005/0002054 | A1 | 1/2005 | Shoji et al. | |
| 2010/0014903 | A1 | 1/2010 | Seto et al. | |
| 2011/0217091 | A1 | 9/2011 | Hirose et al. | |
| 2011/0305491 | A1 | 12/2011 | Hasegawa et al. | |
| 2012/0004087 | A1 * | 1/2012 | Tharayil | B65H 37/00 493/461 |
| 2012/0044516 | A1 | 2/2012 | Hirose et al. | |

* cited by examiner

CONVEYING DEVICE, LIQUID APPLYING APPARATUS, IMAGE FORMING APPARATUS, AND POST-PROCESSING APPARATUS

CROSS-REFERENCE TO RELATED APPLICATION

This patent application is based on and claims priority pursuant to 35 U.S.C. § 119(a) to Japanese Patent Application No. 2020-004285, filed on Jan. 15, 2020, in the Japan Patent Office, the entire disclosure of which is hereby incorporated by reference herein.

BACKGROUND

Technical Field

Embodiments of the present disclosure relate to a conveying device, a liquid applying apparatus, an image forming apparatus, and a post-processing apparatus.

Background Art

Various types of image forming apparatuses such as copiers and printers are known to include a conveying device that conveys a sheet to which liquid such as ink is applied.

When a sheet has a curl, a known conveying device causes the sheet to pass between a belt and a conveyance drive roller, so that the sheet is warped in a direction opposite a curling direction of the curl on the sheet to decurl the curl of the sheet. Further, such a known conveying device includes a plurality of rollers around which the belt is wound. One of the plurality of rollers is movably disposed to approach and separated with respect to the conveyance drive roller. With this configuration of the known conveying device, the winding angle of the belt with respect to the conveyance drive roller is changed according to the amount of curl of the sheet.

SUMMARY

At least one aspect of this disclosure, a novel conveying device includes a pair of rotary bodies and a movable member. The pair or rotary bodies includes a first rotary body disposed in a first region, and a second rotary body disposed in a second region and facing the first rotary body across a sheet conveyance passage through which a sheet applied with liquid is conveyed. The movable member is disposed upstream from the first rotary body in a sheet conveyance direction. The movable member is configured to move between the first region and the second region with respect to the sheet conveyance passage. The movable member is configured to move to the second region in a middle of conveyance of the sheet between the first rotary body and the second rotary body.

Further, at least one aspect of this disclosure, another novel conveying device includes a pair of rotary bodies and a movable member. The pair or rotary bodies includes a first rotary body disposed in a first region, and a second rotary body disposed in a second region and facing the first rotary body across a sheet conveyance passage through which a sheet applied with liquid is conveyed. The movable member is configured to contact an upstream side of the sheet from the pair of rotary bodies in a sheet conveyance direction while the sheet is held by the pair of rotary bodies. The movable member is configured to move to change a position of the movable member.

Further, at least one aspect of this disclosure, a liquid applying apparatus includes a liquid applier configured to apply a liquid to a sheet, and the above-described conveying device.

Further, at least one aspect of this disclosure, an image forming apparatus includes an image forming device configured to form an image on a sheet with liquid, and the above-described conveying device.

Further, at least one aspect of this disclosure, a post-processing apparatus includes the above-described conveying and a post-processing device configured to perform a post-processing operation to a sheet.

BRIEF DESCRIPTION OF THE SEVERAL VIEWS OF THE DRAWINGS

Exemplary embodiments of this disclosure will be described in detail based on the following figures, wherein.

Figure 1:
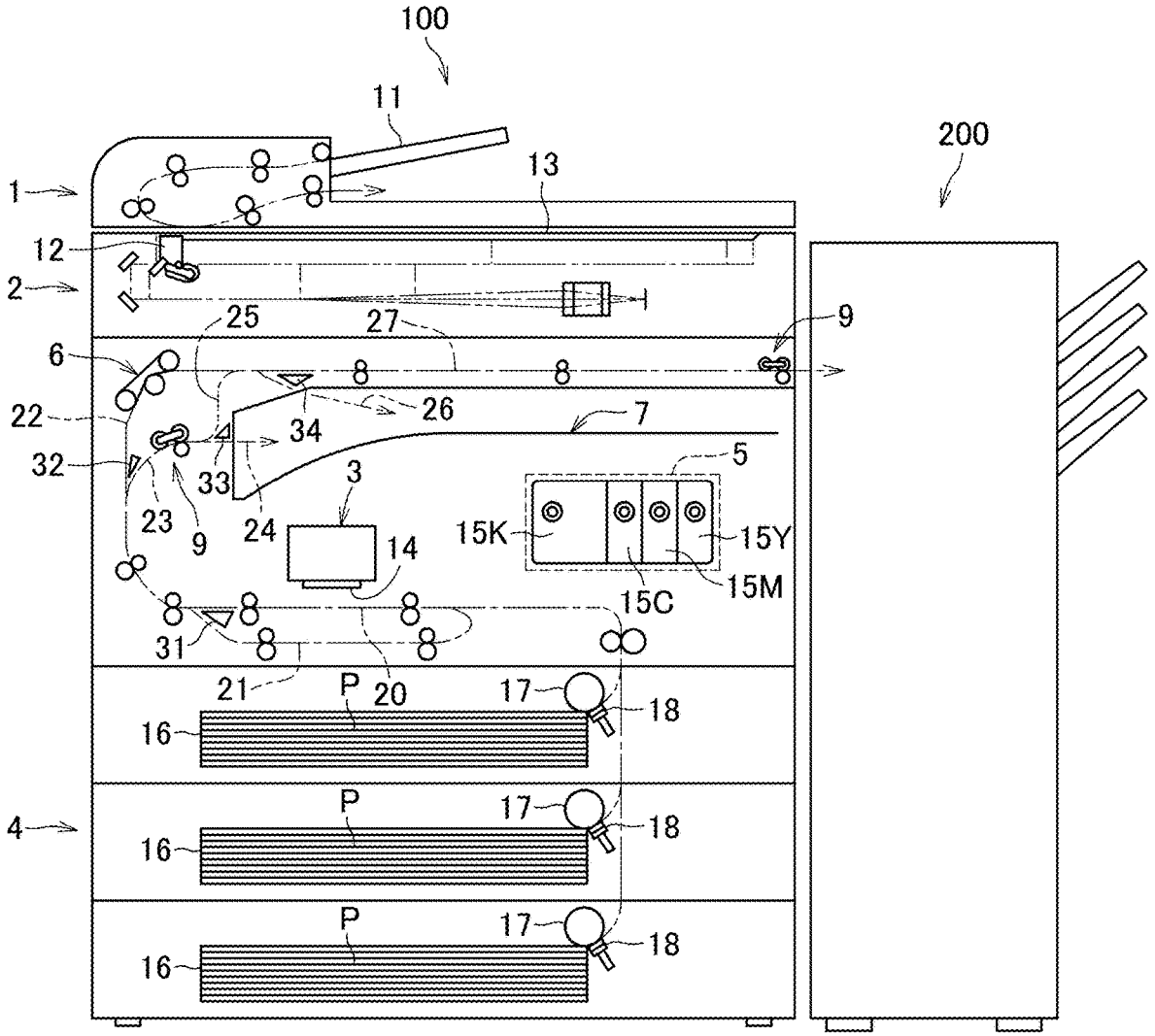
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a conveying device, a liquid discharge apparatus, an image forming apparatus, a post-processing apparatus, and a conveying device. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device (heating device) 6, a sheet ejection portion 7, and a sheet ejection device 9. Further, a sheet alignment apparatus 200 is disposed adjacent to the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid discharger to discharge ink that is liquid used for image formation. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The drying device 6 includes a pair of heat rotators that heat a sheet while conveying the sheet with the sheet interposed between the heat rotators. A heating source included in the drying device 6 may be a radiant-heat-type heater that emits infrared rays such as a halogen heater or a carbon heater, or an electromagnetic-induction-type heating source. Alternatively, the drying device 6 may be a hot air generator that blows hot air onto the sheet to heat the sheet.

The sheet ejection device 9 is provided near an ejection port through which the sheet is ejected to the sheet ejection portion 7 and near an ejection port through which the sheet is transferred to the sheet alignment apparatus 200. A detailed description of the sheet ejection device 9 is deferred.

The sheet alignment apparatus 200 functions as a post-processing apparatus to align and register the sheets P conveyed from the image forming apparatus 100. Further, in addition to the sheet alignment apparatus 200, another post-processing apparatus such as a stapling device that staples (binds) the sheets and a punching device that punches holes in the sheet may be installed.

To provide a fuller understanding of the embodiments of the present disclosure, a description is now given of the image forming operation of the image forming apparatus 100 according to the present embodiment of this disclosure, with continued reference to FIG. 1.

As an instruction is given to start the printing operation, the sheet P is fed from one sheet feed tray 16 of the plurality of sheet feed trays 16. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When a duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the sheet P is conveyed in the opposite direction. Further, after the trailing end of the sheet P has passed the first passage changer 31, the first passage changer 31 changes the sheet conveyance passage of the sheet P to the sheet reverse passage 21. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. Note that, when drying the ink on the front face of the sheet P and then forming an image on the back face of the sheet P in the duplex printing, the drying device 6 dries the ink on the front face of the sheet P first, and then, the direction of conveyance of the sheet P is switched back (changed) to a sheet conveyance passage 25 and the sheet conveyance passage 23, and the sheet P is guided to the image forming device 3 again via the sheet reverse passage 21. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the sheet alignment apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the sheet alignment apparatus 200.

In a case in which the sheet P is guided to the sheet conveyance passage 24 or the sheet conveyance passage 26 toward the sheet ejection portion 7, the sheet P is ejected by the sheet ejection device 9 to the sheet ejection portion 7 with a liquid applied face of the sheet P down. On the other hand, when the sheet P is guided to the sheet conveyance passage 25 or the sheet conveyance passage 27 toward the sheet alignment apparatus 200, the sheet P is ejected by another sheet ejection device 9 to the sheet alignment apparatus 200. Then, the sheet P is conveyed to the sheet alignment apparatus 200, so that the bundle of sheets P is aligned and stacked. Accordingly, a series of printing operations is completed.

Next, a description is given of the configuration of the sheet ejection device 9 according to the present embodiment.

However, the sheet ejection device 9 from which the sheet is ejected to the sheet ejection portion 7 basically has the same configuration as the configuration of the sheet ejection device 9 from which the sheet is ejected to the sheet alignment apparatus 200. Therefore, the following description is given of the configuration of one of these sheet ejection devices 9 and the description of the other of these sheet ejection devices 9 will be omitted.

Figure 2:
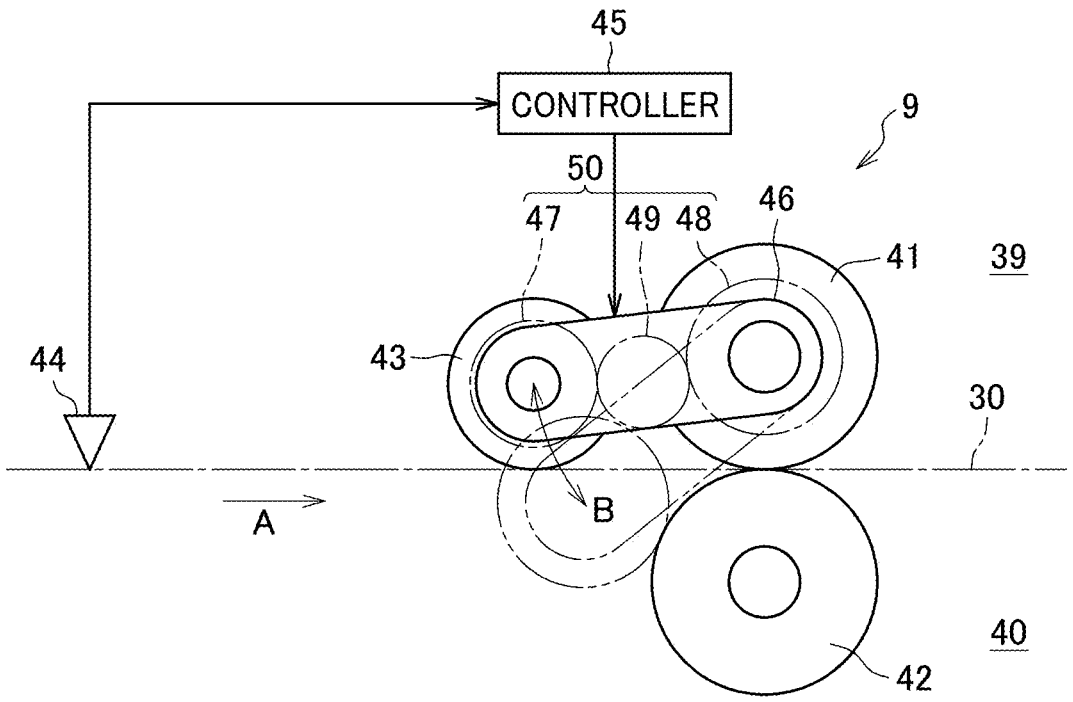
FIG. 2 is a diagram illustrating a schematic configuration of a sheet ejection device included in the image forming apparatus of FIG. 1.

FIG. 2 is a diagram illustrating a schematic configuration of a sheet ejection device according to an embodiment of the present disclosure, included in the image forming apparatus of FIG. 1.

As illustrated in FIG. 2, the sheet ejection device 9 includes a first ejection roller 41, a second ejection roller 42, a movable roller 43, a sheet detection sensor 44, and a controller 45.

The first ejection roller 41 and the second ejection roller 42 function in pair as a pair of rotary bodies disposed facing each other, interposing a sheet conveyance passage 30 through which the sheet is conveyed. Note that, unless otherwise specified, the "sheet conveyance passage 30" and "sheet conveyance passage" described below in the specification indicate a sheet conveyance passage (sheet passing route) through which the leading end of the sheet passes. Since a sheet conveyance passage through which the trailing end of the sheet changes largely according to movement of the movable roller 43 described below, the sheet conveyance passage is not included in any matters to specify the sheet conveyance passage. A drive source such as a motor mounted on the housing of the image forming apparatus 100 drives and rotates the first ejection roller 41. Further, the first ejection roller 41 and the second ejection roller 42 may function as drive rollers. The first ejection roller 41 and the second ejection roller 42 are pressed against each other by a pressing member such as a spring or springs.

The movable roller 43 is disposed upstream from the first ejection roller 41 in a sheet conveyance direction A illustrated in FIG. 2. Further, the movable roller 43 is a moving member that is movable between a first region 39 in which the first ejection roller 41 is disposed and a second region 40 in which the second ejection roller 42 is disposed so that the position of the movable roller 43 changes in a direction indicated by arrow B (hereinafter, the direction B) in FIG. 2, between the first region 39 and the second region 40 based on the sheet conveyance passage 30. To be more specific, in the present embodiment, the movable roller 43 is coupled to the first ejection roller 41 via a coupling member 46. That is, the coupling member 46 couples the movable roller 43 and the first ejection roller 41. By so doing, the movable roller 43 that is coupled with the first ejection roller 41 via the coupling member 46 is rotatably supported to be capable of rotating in the direction B about the rotary shaft of the first ejection roller 41. That is, the movable roller 43 according to the present embodiment moves in an arc shape around the rotary shaft of the first ejection roller 41, so that the movable roller 43 approaches the second ejection roller 42 and separates from the second ejection roller 42, between the first region 39 and the second region 40.

Further, the movable roller 43 and the first ejection roller 41 are coupled to each other by a gear train 50 that functions as a power transmission member including a plurality of gears, which are a movable roller gear 47, an ejection roller gear 48, and a middle gear 49, each functioning as a power transmission member so that the movable roller 43 and the first ejection roller 41 operate simultaneously with each other. To be more specific, the gear train 50 includes the movable roller gear 47, the ejection roller gear 48, and the middle gear 49. The movable roller gear 47 rotates together with the movable roller 43 as a single unit. The ejection roller gear 48 rotates together with the first ejection roller 41. The middle gear 49 is disposed between the movable roller gear 47 and the ejection roller gear 48 and is meshed with each of the movable roller gear 47 and the ejection roller gear 48. To be more specific, since the movable roller 43 and the first ejection roller 41 are coupled to each other via the gear train 50, as the first ejection roller 41 rotates, the driving force applied by the first ejection roller 41 is transmitted to the movable roller 43. Consequently, the movable roller 43 rotates simultaneously with the rotation of the first ejection roller 41. Further, the movable roller gear 47 and the middle gear 49 move together, along with movement of the movable roller 43 in the direction B in FIG. 2.

The sheet detection sensor 44 is a sheet detector that detects a sheet such as a paper. The sheet detection sensor 44 is a light reflection type optical sensor or a light transmission type optical sensor, for example. The sheet detection sensor 44 includes a light emitting element and a light receiving element to detect the trailing end of a sheet, in other words, the timing at which the trailing end of a sheet passes. The sheet detection sensor 44 is disposed upstream from the movable roller 43 in the sheet conveyance direction A.

The controller 45 controls movement of the movable roller 43 in the direction B and the amount of movement of the movable roller 43, based on the detection signal of the sheet detection sensor 44. The controller 45 includes, e.g., a central processing unit (CPU) disposed in the housing of the image forming apparatus 100.

Figure 3:
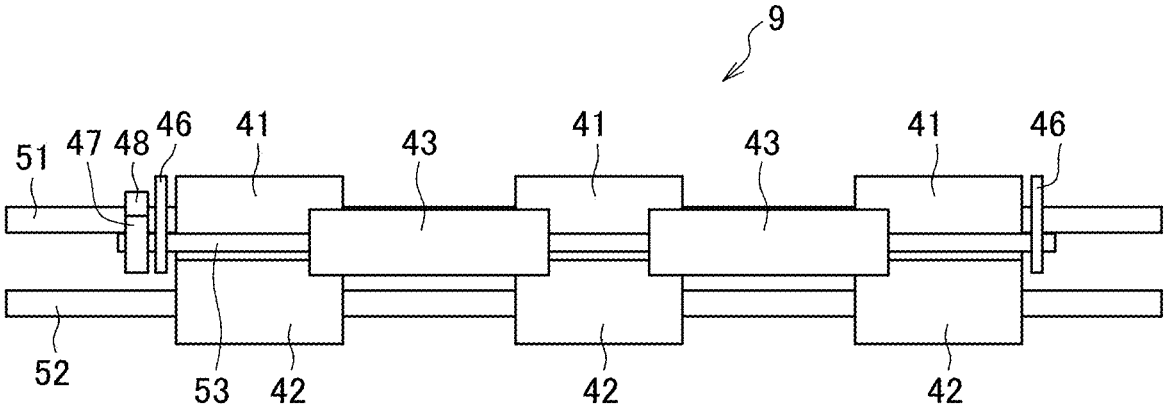
FIG. 3 is a diagram illustrating the sheet ejection device of FIG. 2, viewed from the upstream side in a sheet conveyance direction.

FIG. 3 is a diagram illustrating the sheet ejection device 9 of FIG. 2, viewed from the upstream side in the sheet conveyance direction A.

As illustrated in FIG. 3, the first ejection rollers 41 are provided intermittently in the axial direction of a rotary shaft 51. Similarly, the second ejection rollers 42 are provided intermittently in the axial direction of a rotary shaft 52. In addition, the movable rollers 43 are provided intermittently in the axial direction of a rotary shaft 53. However, the movable rollers 43 are disposed so as to be shifted in the axial direction from the first ejection rollers 41 and the second ejection rollers 42, except for parts of the movable rollers 43 in the axial direction. By contrast, the parts of the movable roller 43 in the axial direction are dispose facing the first ejection rollers 41 and the second ejection rollers 42. That is, the area of the parts of the movable roller 43 is located to be contactable with the outer circumferential surface of the second ejection roller 42 when the movable roller 43 approaches the second ejection roller 42. Note that each structure of the movable roller 43, the first ejection roller 41, and the second ejection roller 42 is not limited to the example illustrated in FIG. 3. For example, the movable roller 43, the first ejection roller 41, and the second ejection roller 42 may be a single roller provided continuously in the axial directions.

Next, a description is given of the back curl on a sheet generated in the liquid discharge type image forming apparatus according to the present embodiment.

Figure 4:
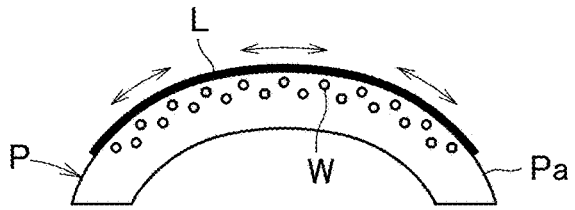
FIG. 4 is a diagram for explaining the principle of generation of a back curl on a sheet.

FIG. 4 is a diagram for explaining the principle of generation of a back curl on the sheet P.

Generally, in a case of a plain paper, when liquid L is applied to one side, that is, the liquid applied face Pa of the sheet P as illustrated in FIG. 4, water W in the liquid L stretches fabric on the liquid applied face Pa of the sheet P in a specified direction, which generates a curl. More specifically, the water W permeates between the cellulose fibers of the sheet P and breaks the hydrogen bond of the cellulose fibers. By so doing, the intervals of the cellulose fibers increase, and therefore the sheet P extends in the specified direction. As a result, the sheet P warps upward to cause the liquid applied face Pa (image forming surface) to have a curl in a convex shape. The curl is referred to as a back curl.

Further, in an electrophotographic image forming apparatus that forms an image with toner, the toner applied face of the sheet is heated at the temperature higher than the temperature of the opposite face that is opposite the toner applied face of the sheet to fix the toner to the sheet. This heating may result in generation of a curl that is similar to the back curl.

Figure 5:
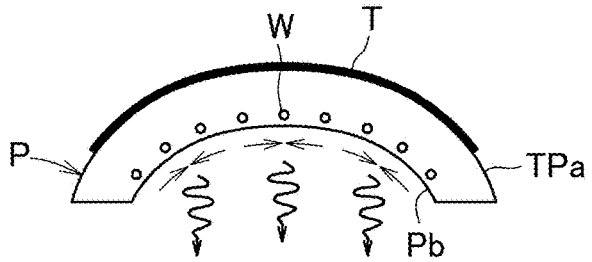
FIG. 5 is a diagram for explaining the principle of generation of another back curl on a sheet.

FIG. 5 is a diagram for explaining the principle of generation of another back curl on a sheet P.

That is, as illustrated in FIG. 5, when the toner applied face TPa of the sheet P, to which toner T is applied, is heated with the high temperature, the water content of the water W originally contained in the sheet P is higher on the opposite face Pb than on the toner applied face TPa. Therefore, the shrinkage of the sheet P caused by the subsequent drying is more remarkable on the opposite face Pb than on the toner applied face TPa. As a result, this shrinkage causes the toner applied face TPa (image forming surface) of the sheet P to warp upward in a convex shape to generate a back curl.

In the liquid discharge type image forming apparatus, in a case in which the back curl as illustrated in FIG. 4 occurs, when the sheet is ejected to the outside of the image forming apparatus, the leading end of the sheet is caught by the trailing end of the sheet that has been ejected earlier. Therefore, the paper jam is likely to occur. Therefore, in order to eject the sheet reliably, the back curl needs to be decurled to restrain the amount of curl.

However, different from the back curl generated by application of heat as illustrated in FIG. 5, the back curl generated by application of liquid to the sheet is a temporary back curl in which the amount of curl decreases along with the elapse of time. Therefore, in a case in which the decurling operation is performed on the back curl over the entire sheet, it is likely that the sheet warps in the direction opposite the decurling direction to result in generation of another curl. Further, in order to prevent the sheet from being caught by the trailing end of the sheet when ejecting the sheet, at least the back curl on the trailing end of the sheet needs to be decurled, and therefore the back curl may not need to be decurled over the entire sheet.

In the embodiment of the present disclosure, in order to perform the decurling operation mainly on the portion of the sheet that needs to be decurled, the sheet is ejected as described below. Next, a description is given of the sheet ejection operation performed by the sheet ejection device according to an embodiment of the present disclosure.

Figure 6:
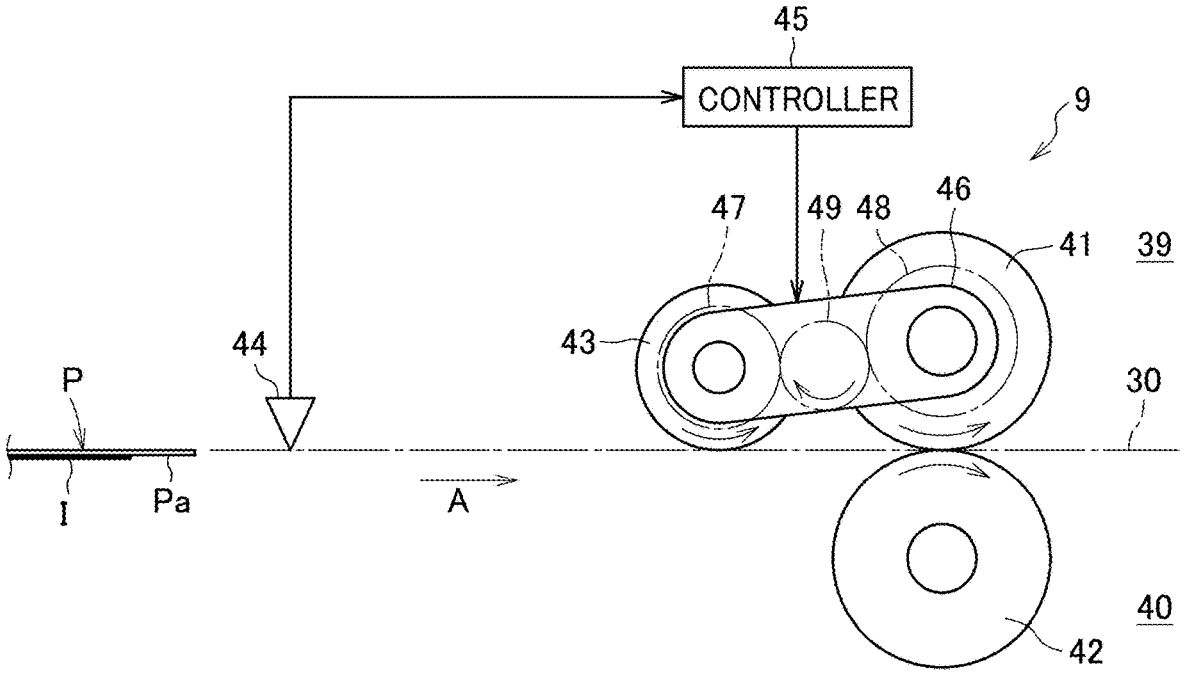
FIG. 6 is a diagram for explaining a sheet ejection operation performed by the sheet ejection device of FIG. 2.

FIG. 6 is a diagram for explaining the sheet ejection operation performed by the sheet ejection device of FIG. 2.

Figure 7:
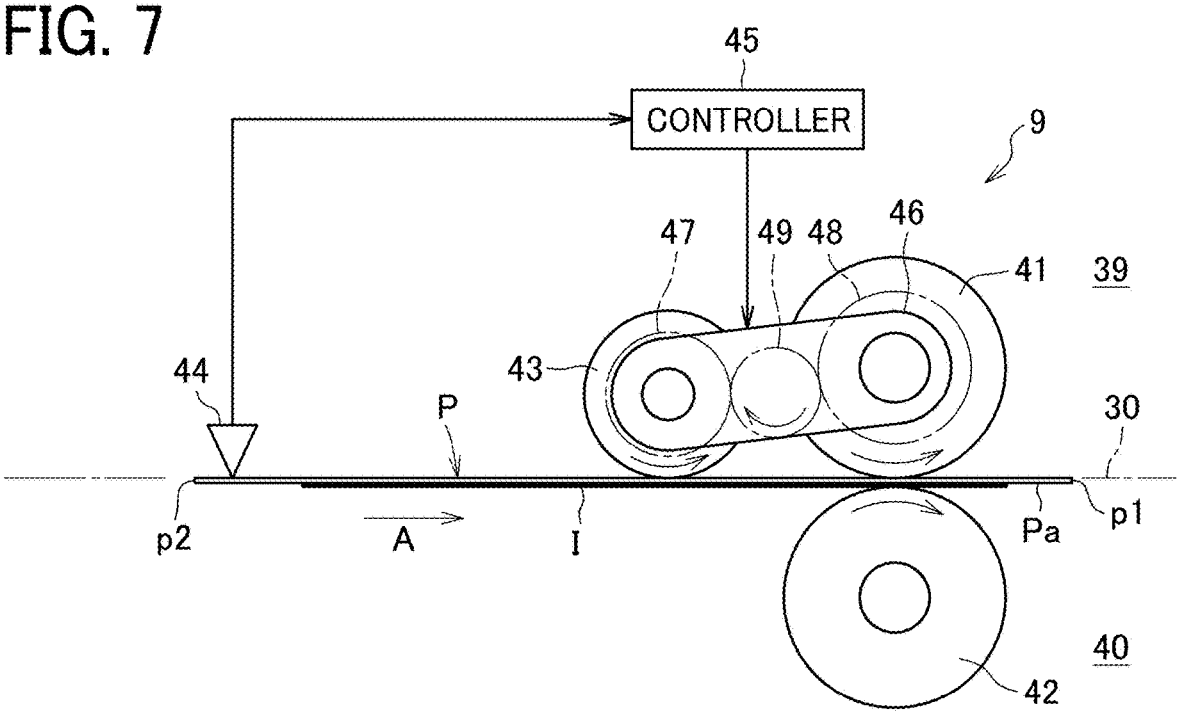
FIG. 7 is a diagram for explaining the sheet ejection operation subsequent to FIG. 6, performed by the sheet ejection device.

FIG. 7 is a diagram for explaining the sheet ejection operation subsequent to FIG. 6, performed by the sheet ejection device of FIG. 2.

Figure 8:
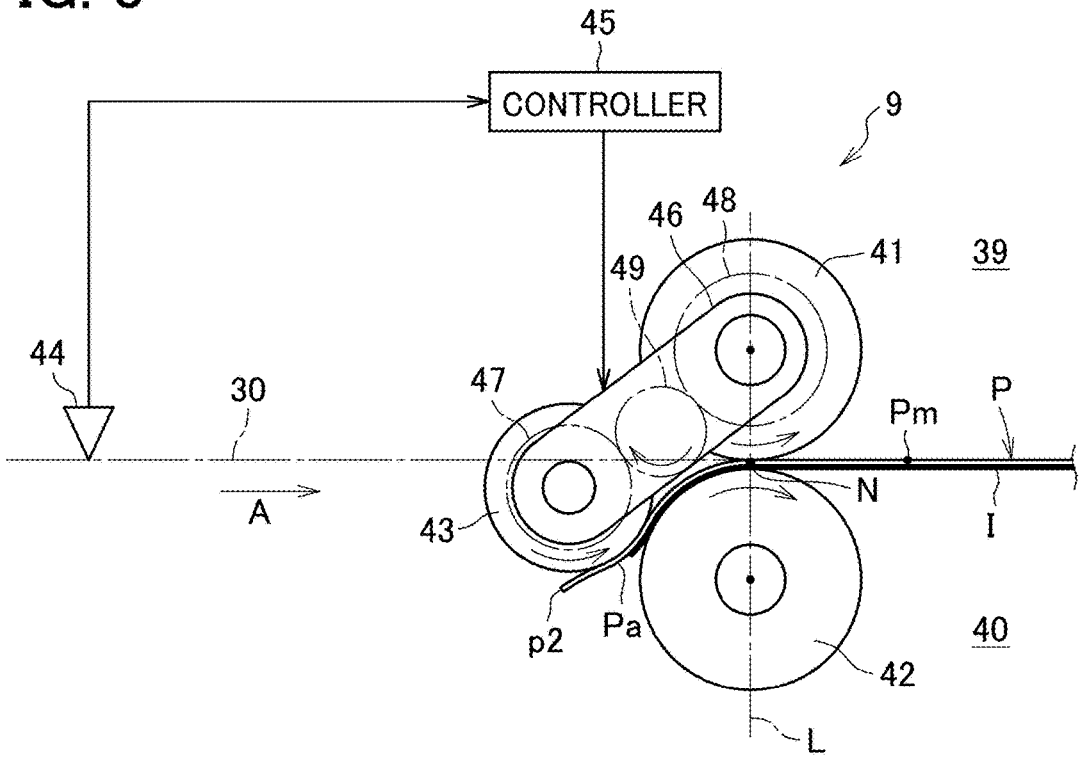
FIG. 8 is a diagram for explaining the sheet ejection operation subsequent to FIG. 7, performed by the sheet ejection device.

FIG. 8 is a diagram for explaining the sheet ejection operation subsequent to FIG. 7, performed by the sheet ejection device of FIG. 2.

First, as illustrated in FIG. 6, as the sheet P on which the ink I is applied is conveyed to the sheet ejection device 9, the first ejection roller 41 starts rotating, and the second ejection roller 42 and the movable roller 43 are rotated along with the rotation of the first ejection roller 41. Further, at this time, the movable roller 43 is not approached to the second ejection roller 42 and is disposed in the first region 39, that is, spaced away from the second ejection roller 42.

Then, as illustrated in FIG. 7, as the leading end p1 of the sheet P enters between the first ejection roller 41 and the second ejection roller 42, the first ejection roller 41 and the second ejection roller 42 convey the sheet P while the first ejection roller 41 and the second ejection roller 42 are rotating. Then, when the sheet detection sensor 44 detects trailing end p2 of the sheet detection sensor 44, the controller 45 issues the instruction to move the movable roller 43, so that the movable roller 43 moves in a direction in which the movable roller 43 approaches the second ejection roller 42, that is, toward the second region 40.

As illustrated in FIG. 8, as the movable roller 43 approaches the second ejection roller 42, trailing end p2 of the sheet P is held (gripped) by the movable roller 43 and the second ejection roller 42. Accordingly, the trailing end p2 of the sheet P is pressed against the second ejection roller 42 by the movable roller 43, and the liquid applied face Pa of the sheet P, on which the ink I (liquid) is applied, is warped over the sheet conveyance direction A to form a concaved (recessed) shape. Then, the trailing end p2 of the sheet P passes between the movable roller 43 and the second ejection roller 42, and further passes between the first ejection roller 41 and the second ejection roller 42, and the sheet P is ejected eventually.

Further, in the sheet ejection device 9 according to the present embodiment, the trailing end p2 of the sheet P is pressed against the second ejection roller 42 by the movable roller 43, and the liquid applied face Pa of the sheet P is warped over the sheet conveyance direction A to form a concaved (recessed) shape. That is, the trailing end p2 of the sheet P is conveyed while being warped in the opposite direction opposite the curling direction of the back curl, in other words, the curling direction in which the liquid applied face Pa is warped in a convex (projecting) shape. Accordingly, the back curl on the trailing end p2 of the sheet P is decurled. Accordingly, the sheet ejection device 9 according to the present embodiment restrains occurrence of the paper jam caused when the leading end of the sheet is caught by the trailing end of the previous sheet that is ejected prior to the sheet P.

On the other hand, since the leading end p1 of the sheet P is not pressed against the second ejection roller 42 by the movable roller 43, the decurling operation on the leading end p1 of the sheet P is hardly performed to decurl the back curl on the leading end p1 of the sheet P. As described above, even if the decurling operation is not performed to decurl the back curl on the leading end p1 of the sheet P, as long as the back curl on the trailing end p2 of the sheet P is restrained, the paper jam that is likely to occur when ejecting the sheet P is prevented. Further, since the amount of curl of the back curl generated due to application of liquid decreases as the time elapses, even if the back curl is generated on the leading end p1 of the sheet P immediately after the ejection of the sheet P, the back curl on the leading end p1 of the sheet P is thereafter eliminated naturally. Accordingly, by hardly performing the decurling operation to the back curl on the leading end p1 of the sheet P to which the decurling operation is not needed, thereby restraining generation of another curl on the sheet P in the opposite direction to the curling direction of the back curl.

As described above, the sheet ejection device 9 according to the present embodiment provides the decurling operation by the movable roller 43 to the trailing end of the sheet to which the back curl needs to be decurled and hardly provides the decurling operation to any portion on the sheet other than the trailing end. By so doing, generation of another curl generated due to the decurling operation is restrained. Accordingly, the back curl on the trailing end of the sheet is decurled so that the sheet is ejected smoothly and generation of another curl after ejection of the sheet is restrained.

As long as the sheet P is in the middle of passing a gap N between the first ejection roller 41 and the second ejection roller 42, the timing to bring the movable roller 43 to approach the second ejection roller 42 may be adjusted appropriately according to the size of the area in which the length of the sheet P and the decurling operation to the sheet P are needed. For example, when the area in which the decurling operation needs to be performed is relatively large in the sheet conveyance direction, the approach timing at which the movable roller 43 approaches the second ejection roller 42 is made earlier, so that the decurling operation is performed on the area that needs to be decurled.

Further, in order to decurl the back curl generated on the sheet P toward the trailing end p2 from the intermediate position of the sheet P in the sheet conveyance direction, it is preferable that the movable roller 43 approaches the second ejection roller 42 after the intermediate position Pm of the sheet P in the sheet conveyance direction (see FIG. 8) has passed the gap N between the first ejection roller 41 and the second ejection roller 42.

In order to more effectively decurl the back curl on the trailing end of the sheet P, it is preferable that the movable roller 43 presses the sheet P in the range from 30 mm to 100 mm from the trailing end p2 to the leading end p1 against the second ejection roller 42. Therefore, in the present embodiment, the sheet detection sensor 44 is disposed upstream from the movable roller 43 in the distance of 100 mm or more in the sheet conveyance direction A, so that the timing to move the movable roller 43 is controlled based on the detection timing of the trailing end of the sheet detected by the sheet detection sensor 44.

Further, in the sheet ejection device 9 according to the present embodiment, the movable roller 43 is coupled with the first ejection roller 41 via the gear train 50 so as to move together with the first ejection roller 41. Therefore, as the first ejection roller 41 rotates, the movable roller 43 is rotated along with rotation of the first ejection roller 41 in the same direction as the first ejection roller 41. Therefore, when the sheet P comes into contact with the movable roller 43, the movable roller 43 conveys the sheet P toward downstream in the sheet conveyance direction while the movable roller 43 is rotating, thereby ejecting the sheet P smoothly. Further, in order to eject the sheet P more smoothly, it is desirable that the rotational speed of the movable roller 43 is the same as the rotational speed of the first ejection roller 41.

Further, the amount of approach of the movable roller 43 to the second ejection roller 42, in other words, the amount of movement of the movable roller 43 to the second region 40 may be adjustable. For example, when an image having a low coverage rate with texts, the amount of ink application to the sheet P is relatively small, and therefore it is less likely to generate a back curl easily, in other words, it is likely that no back curl is generated or the amount of curl is small. Further, since a thick sheet has the stiffness greater than a thin sheet, it is less likely to generate the back curl on the thick sheet. In the above-described cases, when the decurling operation to decurl the back curl is performed uniformly to various types of sheets, it is likely that the back curl is not restrained sufficiently or, by contrast, a face curl is generated due to the excessive decurling operation to the back curl on the sheet. Therefore, it is preferable to adjust the amount of movement of the movable roller 43 according to the liquid applied area rate (printing rate) of the sheet, the amount of liquid application, and the thickness of the sheet.

Figure 9:
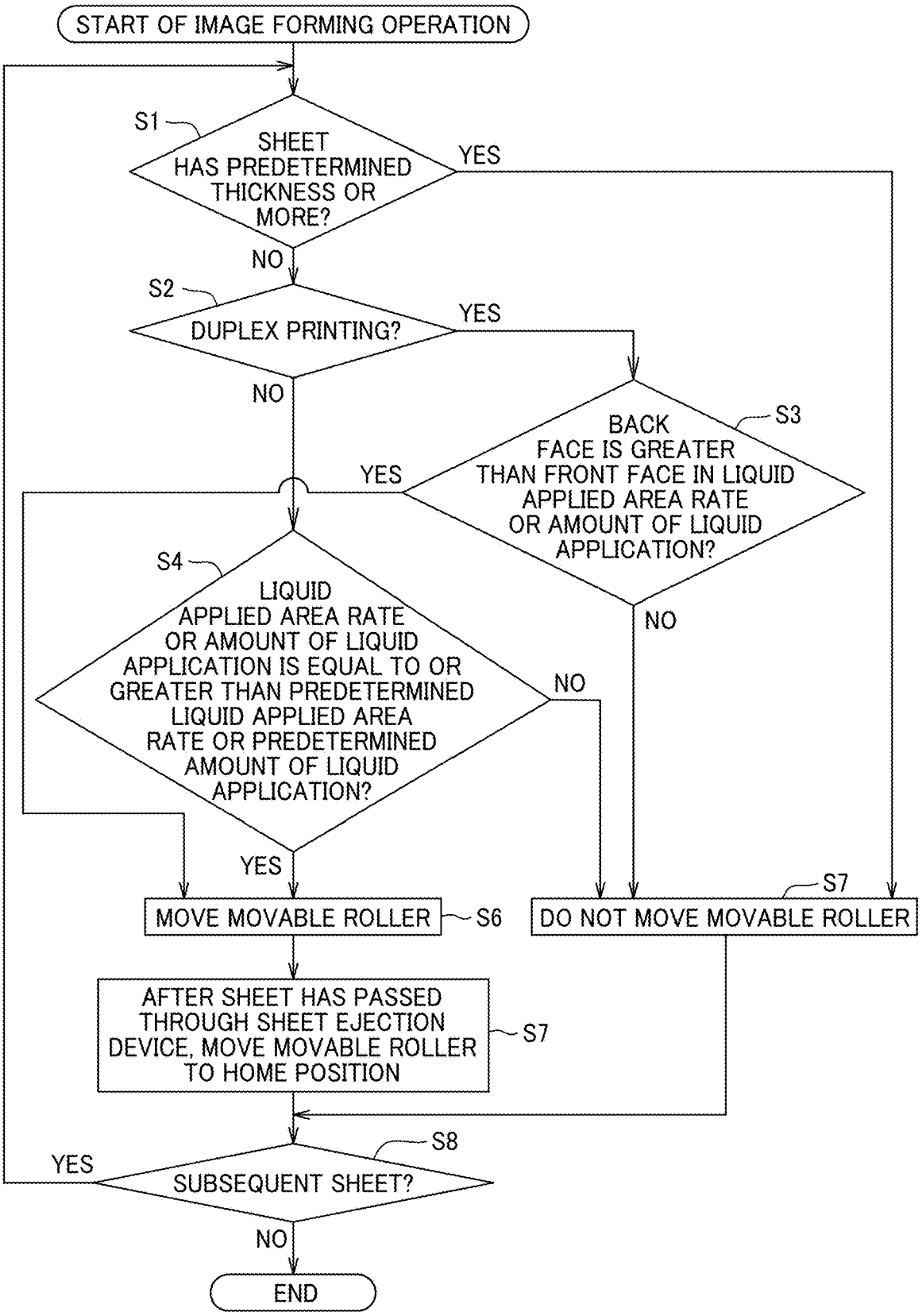
FIG. 9 is a diagram illustrating a control flow of a movable roller in a case in which the amount of movement of the movable roller is adjustable.

FIG. 9 is a diagram illustrating a control flow of the movable roller 43 in a case in which the amount of movement of the movable roller 43 is adjustable.

As illustrated in FIG. 9, as an instruction to start the image forming operation is issued, the controller 45 determines whether the thickness of the sheet is equal to or greater than the predetermined thickness. In other words, the controller 45 determined whether the sheet has the predetermined thickness or more (step S1 in FIG. 9).

As a result, when the thickness of the sheet is equal to or greater than the predetermined thickness (YES in step S1), the controller 45 determines that the back curl is hardly generated and causes the movable roller 43 not to move to the second region 40 (step S7 in FIG. 9).

By contrast, when the thickness of the sheet is smaller than the predetermined thickness (NO in step S1), the process proceeds to the next step.

In the next step, the controller 45 determines whether the image formation mode is the single-side printing mode or the duplex printing mode (step S2 in FIG. 9).

As a result, when the image formation mode is the duplex printing mode (YES in step S2), the controller 45 determines whether the liquid applied area rate or the amount of liquid application on the back face of the sheet is greater than the liquid applied area rate or the amount of liquid application of the front face of the sheet (step S3 in FIG. 9).

As a result, when the liquid applied area rate or the amount of liquid application on the back face of the sheet is greater than the liquid applied area rate or the amount of liquid application on the front face of the sheet (YES in step S3), the controller 45 determines that the back curl is easily generated and causes the movable roller 43 to move to the second region 40 so as to decurl the back curl on the trailing end of the sheet (step S6 in FIG. 9).

On the other hand, when the liquid applied area rate or the amount of liquid application on the back face of the sheet is equal to or smaller than the liquid applied area rate or the amount of liquid application on the front face of the sheet (NO in step S3), the controller 45 determines that the back curl is hardly generated and causes the movable roller 43 not to move to the second region 40 (step S7 in FIG. 9). Note that it is preferable that the controller 45 determines (controls) whether or not to move the movable roller 43 to the second region 40 according to the result of comparison of the front face and the back face of the sheet with respect to the liquid applied area rate or the amount of liquid application on the area downstream from the center position in the sheet conveyance direction, in particular, when the back face of the sheet is conveyed.

Further, when the image formation mode is the single-side printing mode (NO in step S2), the controller 45 determines whether the liquid applied area rate or the amount of liquid application of the sheet is equal to or greater than the predetermined liquid applied area rate or the predetermined amount of liquid application of the sheet (step S4 in FIG. 9).

As a result, when the liquid applied area rate or the amount of liquid application of the sheet is equal to or greater than the predetermined liquid applied area rate or the predetermined amount of liquid application of the sheet (YES in step S4), the controller 45 determines that the back curl is easily generated and causes the movable roller 43 to move to the second region 40 so as to decurl the back curl on the trailing end of the sheet (step S6 in FIG. 9).

On the other hand, when the liquid applied area rate or the amount of liquid application of the sheet is smaller than the predetermined liquid applied area rate or the predetermined amount of liquid application of the sheet (NO in step S4), the controller 45 determines that the back curl is hardly generated and causes the movable roller 43 not to move to the second region 40 (step S7 in FIG. 9). Note that it is preferable that the controller 45 determines (controls) whether or not to move the movable roller 43 to the second region 40 according to the result of comparison of the front face and the back face of the sheet with respect to the liquid applied area rate or the amount of liquid application on the area downstream from the center position in the sheet conveyance direction, in particular, when the back face of the sheet is conveyed.

As described above, when the sheet is ejected in a state in which the movable roller 43 is moved to the second region 40, after the sheet has passed through the sheet ejection device 9, the controller 45 causes the movable roller 43 to move to the home position (i.e., the first region 39) (step S7 in FIG. 9).

Then, the controller 45 determines whether or not there is a subsequent sheet to be conveyed (step S8 in FIG. 9). When there is a subsequent sheet (YES in step S8), the process moves back to step S1 to repeat the procedure until the controller 45 determines that there is no subsequent sheet in step S8. When there is no subsequent sheet (NO in step S8), the image forming operation ends.

As described above, when the back curl is easily generated, the movable roller 43 is moved to the second region 40 to decurl the back curl on the trailing end of the sheet P. By contrast, when the back curl is hardly generated, the movable roller 43 is not moved to the second region 40, thereby restraining the face curl on the sheet, which is likely to be generated by performing the decurling operation that is not needed to the sheet.

Further, the amount of movement of the movable roller 43 may be adjusted according to the determination by the controller 45 based on the degree of occurrence of the back curl, as described above. That is, in a case in a case in which the controller 45 has determined that the back curl is hardly generated, in each determination process in the flowchart of FIG. 9 (for example, steps S1, S3, and S4), the amount of movement of the movable roller 43 to the second region 40 may be reduced when compared with the case in which the controller 45 has determined that the back curl is easily generated. In this case, the decurling force according to the amount of curl of the back curl is applied.

Next, a description is given of variation of another configuration according to the present disclosure.

Note that the configuration according to the present disclosure is basically identical to the configuration according to the above-described embodiment. Therefore, the following description is made for the configuration of variation that is different from the configuration of the above-described configuration, and the description of the other common configuration will be omitted.

Figure 10:
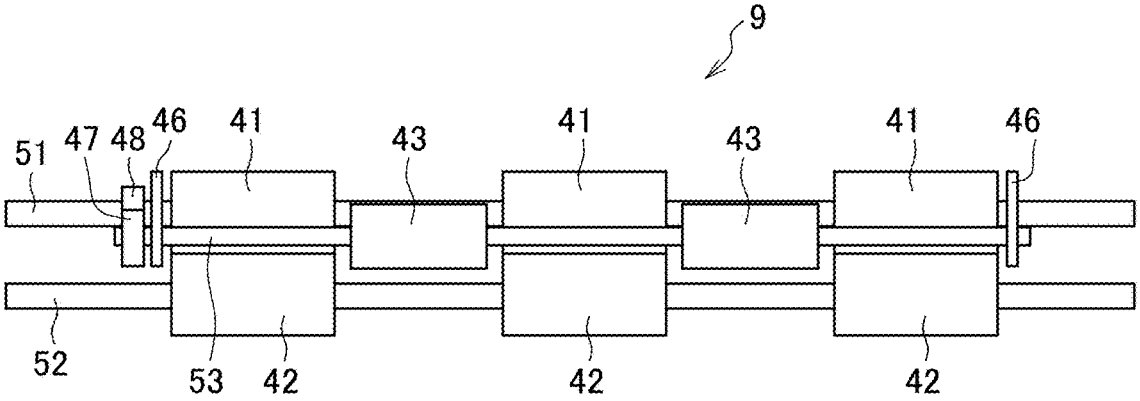
FIG. 10 is a diagram illustrating the configuration of the sheet ejection device according to another embodiment of the present disclosure.

FIG. 10 is a diagram illustrating the configuration of the sheet ejection device according to another embodiment of the present disclosure.

Figure 11:
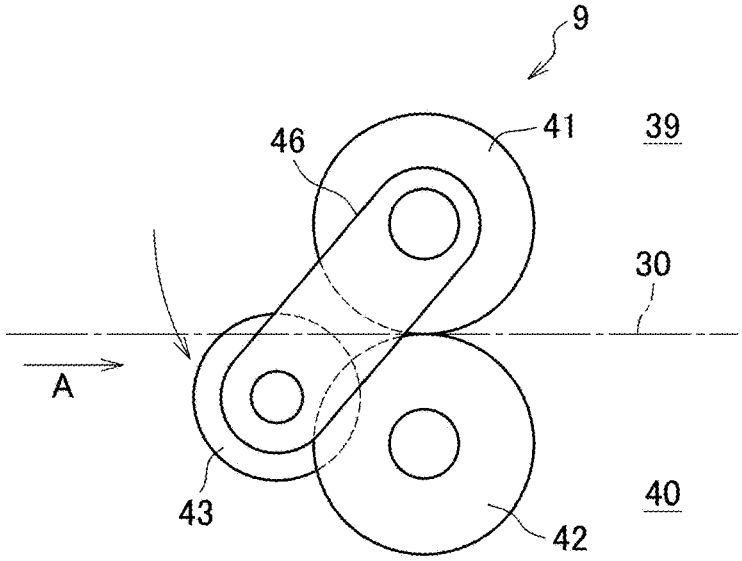
FIG. 11 is a diagram illustrating a state in which the movable roller enters radially inwardly from the position of the outer circumferential surface of a second ejection roller.

FIG. 11 is a diagram illustrating a state in which the movable roller 43 enters radially inwardly from the position of the outer circumferential surface of the second ejection roller 42.

Figure 12:
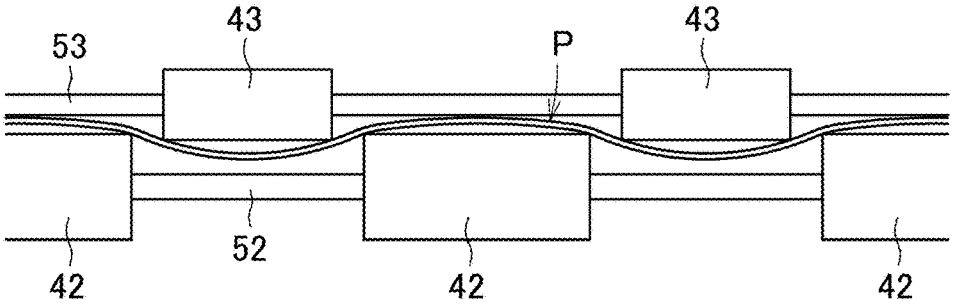
FIG. 12 is a diagram illustrating a state in which the movable roller and the second ejection roller warp the sheet in a waveform.

FIG. 12 is a diagram illustrating a state in which the movable roller 43 and the second ejection roller 42 warp the sheet P in a shape of a waveform.

Figure 13:
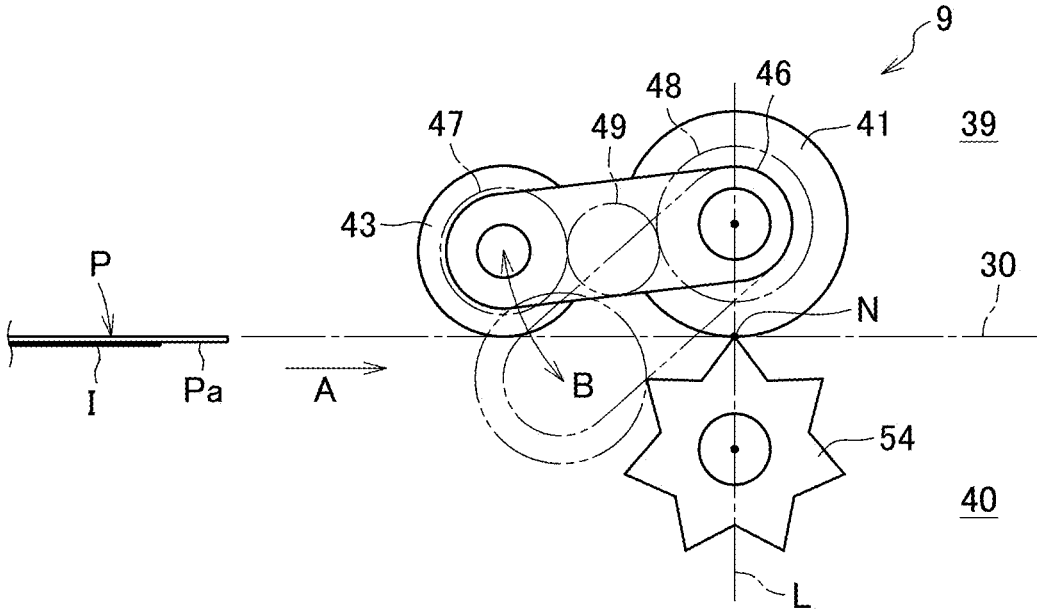
FIG. 13 is a diagram illustrating the sheet ejection device including spur wheels instead of the second ejection roller.

FIG. 13 is a diagram illustrating the sheet ejection device 9 including spur wheels 54 instead of the second ejection roller 42.

In the example illustrated in FIG. 10, different from the configuration of the above-described embodiment (FIG. 3), each movable roller 43 is entirely shifted from the first ejection roller 41 and the second ejection roller 42 in the axial direction. In this case, when the movable roller 43 approaches the second ejection roller 42, the movable roller 43 does not come into contact with the outer circumferential surface of the second ejection roller 42.

Consequently, in this example, as illustrated in FIG. 11, when the movable roller 43 moves the first region 39 to the second region 40, the movable roller 43 enters more radially inwardly from the position of the outer circumferential surface of the second ejection roller 42. Therefore, as illustrated in FIG. 12, the movable roller 43 and the second ejection roller 42 convey the sheet P while warping the sheet P in the shape of a waveform in the width direction of the sheet P. Accordingly, the sheet P is ejected smoothly. Further, even if cockling (waving) occurs in the sheet P, the sheet P is conveyed while being warped in the direction opposite the warping direction of the cockling. Thus, the cockling may also be corrected.

As illustrated in FIG. 13, a spur wheel 54 (spur wheels 54) may be employed instead of the second ejection roller 42. Each spur wheel 54 functions as a projecting rotary body having a plurality of projections projecting toward the outer diameter direction, in other words, radially outwardly. Therefore, even if the liquid applied face Pa of the sheet P contacts the spur wheel 54 (projection) or the plurality of spur wheels 54 (projections), the contact area of the spur wheel 54 or the plurality of spur wheels 54 to the liquid applied face Pa is smaller than the contact area of a roller (i.e., the second ejection roller 42. As described above, by using the spur wheel 54 as a rotary body to contact the liquid applied face Pa of the sheet P, the contact area of the rotary body to the liquid applied face Pa is made smaller than the contact area of the roller to the liquid applied face Pa and the ink smudge (image distortion) on the sheet P is reduced. Further, application of ink to the projecting rotary body (spur wheel 54) is restrained, so as to reduce smear on the sheet caused by ink being applied from the projecting rotary body (spur wheel 54) to another sheet.

In the case illustrated in FIG. 13, the movable roller 43 is caused to approach the spur wheel 54 in the middle of passage of the sheet P in the gap N between the first ejection roller 41 and the second ejection roller 42. According to this movement of the movable roller 43 to the spur wheel 54, the back curl of the sheet P is decurled. Here, the gap N "between" the first ejection roller 41 and the spur wheel 54 through which the sheet P passes indicates an intersection point N at which the straight line L passing through the respective rotation centers and the sheet conveyance passage 30 when the first ejection roller 41 and the spur wheel 54 are viewed from these axial directions. This definition is also applied to the case in which the pair of rotary bodies is composed of the first ejection roller 41 and the second ejection roller 42. That is, in the above-described embodiment, the gap "between" the first ejection roller 41 and the second ejection roller 42 through which the sheet P passes represents the intersection point N at which the straight line L passing through the respective rotation centers intersects the sheet conveyance passage 30 when the first ejection roller 41 and the second ejection roller 42 are viewed from these axial directions (see FIG. 8).

Figure 14:
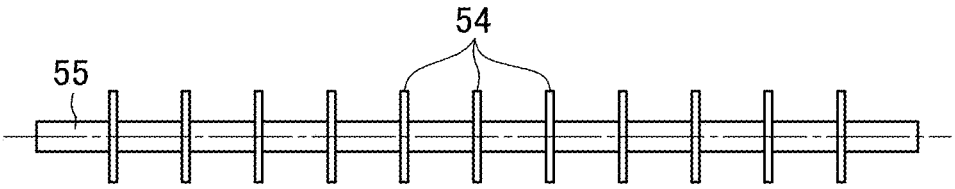
FIG. 14 is a plan view illustrating the sheet ejection device indicating the arrangement of the spur wheels.

FIG. 14 is a plan view illustrating the sheet ejection device 9 indicating the arrangement of the spur wheels 54.

Figure 15:
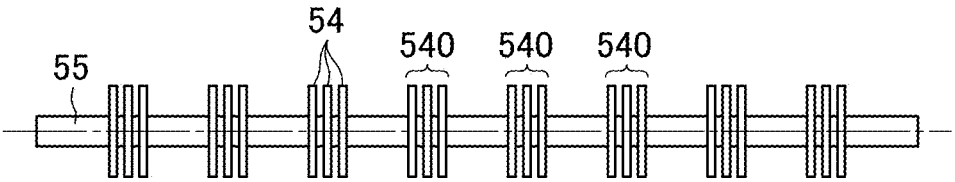
FIG. 15 is a plan view illustrating the sheet ejection device indicating another arrangement of the spur wheels.

FIG. 15 is a plan view illustrating the sheet ejection device 9 indicating another arrangement of the spur wheels 54.

The plurality of spur wheels 54 may be disposed at equal intervals over the axial direction of the support shaft 55, as illustrated in FIG. 14, or may be disposed at different intervals. As illustrated in FIG. 15, spur wheel groups 540, in each of which the plurality of spur wheels 54 are closely disposed to each other, may be disposed at equal intervals or different intervals over the axial direction of the support shaft 55.

Figure 16:
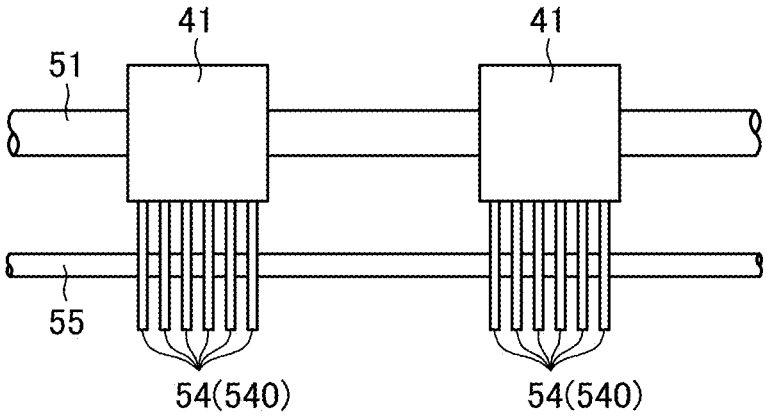
FIG. 16 is a diagram illustrating an example of the arrangement in which the spur wheels and each of first ejection rollers are disposed to contact each other.

FIG. 16 is a diagram illustrating an example of the arrangement in which the spur wheels and each of first ejection rollers are disposed to contact each other.

Figure 17:
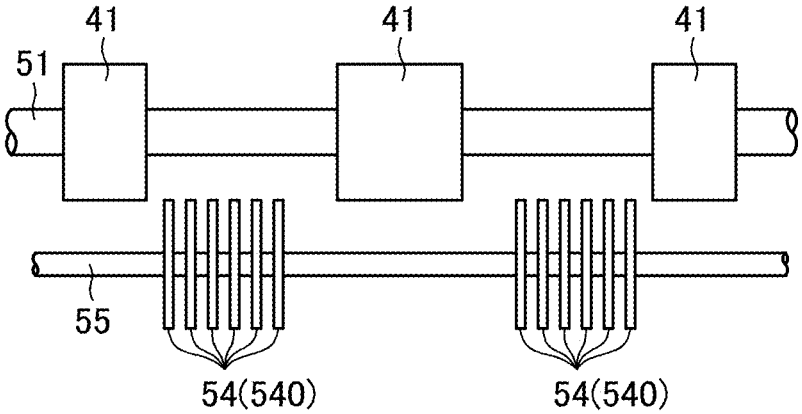
FIG. 17 is a diagram illustrating an example of the arrangement in which the spur wheels and each of the first ejection rollers are shifted in the axial direction so as not to contact each other.

FIG. 17 is a diagram illustrating an example of the arrangement in which the spur wheels and each of the first ejection rollers are shifted in the axial direction so as not to contact each other.

Further, as the example of the configuration illustrated in FIG. 16, the spur wheel 54 and the first ejection roller 41 may be disposed at respective positions to contact with each other along the respective axial directions. Alternatively, as the example of the configuration illustrated in FIG. 17, the spur wheel 54 and the first ejection roller 41 may be disposed to be shifted from each other in the axial directions so as not to contact with each other.

Figure 18:
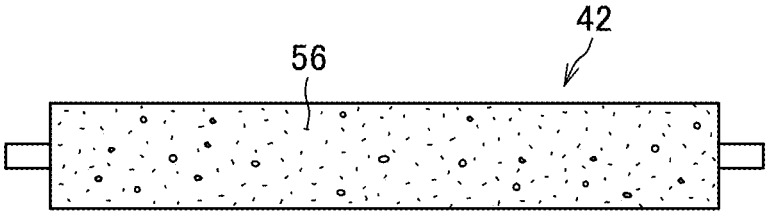
FIG. 18 is a diagram illustrating an example in which an abrasive roller is used as a second ejection roller.
Figure 19:
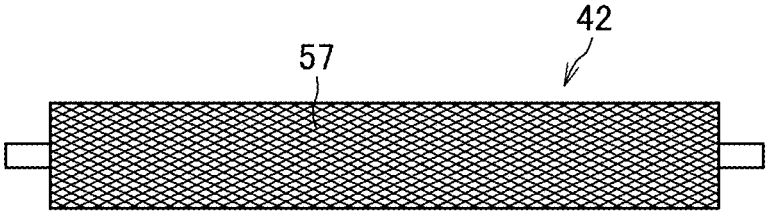
FIG. 19 is a diagram illustrating an example in which a knurled roller is used as the second ejection roller.

Further, as the examples illustrated in FIGS. 18 and 19, a roller having the uneven portions, in other words, having convex and concave portions (asperities) on the outer circumferential surface may be employed as the second ejection roller 42.

FIG. 18 is a diagram illustrating an example in which an abrasive roller is used as a second ejection roller.

FIG. 19 is a diagram illustrating an example in which a knurled roller is used as the second ejection roller.

The abrasive roller illustrated in FIG. 18 has the outer circumferential surface on which abrasive grains 57 such as a plurality of ceramic or glass are attached. The knurl roller illustrated in FIG. 19 has the outer circumferential surface on which meshed convex and concave portions (knurling) 56 are provided. By employing such a roller having uneven outer circumferential surface, in other words, having asperities on the outer circumferential surface, as the second ejection roller 42, application of ink to the second ejection roller 42 is restrained.

Figure 20:
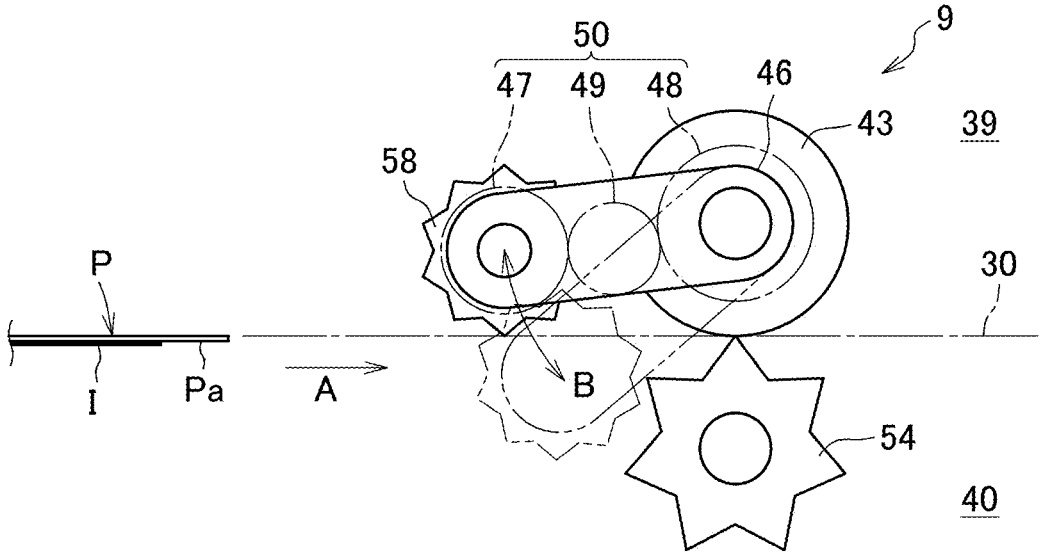
FIG. 20 is a diagram illustrating the sheet ejection device according to an embodiment of the present disclosure, in which the sheet ejection device includes the spur wheels instead of the movable roller.

FIG. 20 is a diagram illustrating the sheet ejection device according to an embodiment of the present disclosure, in which the sheet ejection device includes the spur wheels instead of the movable roller.

As illustrated in FIG. 20, a spur wheel 58 (spur wheels 54) may be employed instead of the movable roller 43. In this case, when the spur wheel 58 approaches another spur wheel, i.e., the spur wheel 54, the sheet P is warped to decurl the back curl. Further, the spur wheel 58 may be coupled with the first ejection roller 41 via the gear train 50.

Figure 21:
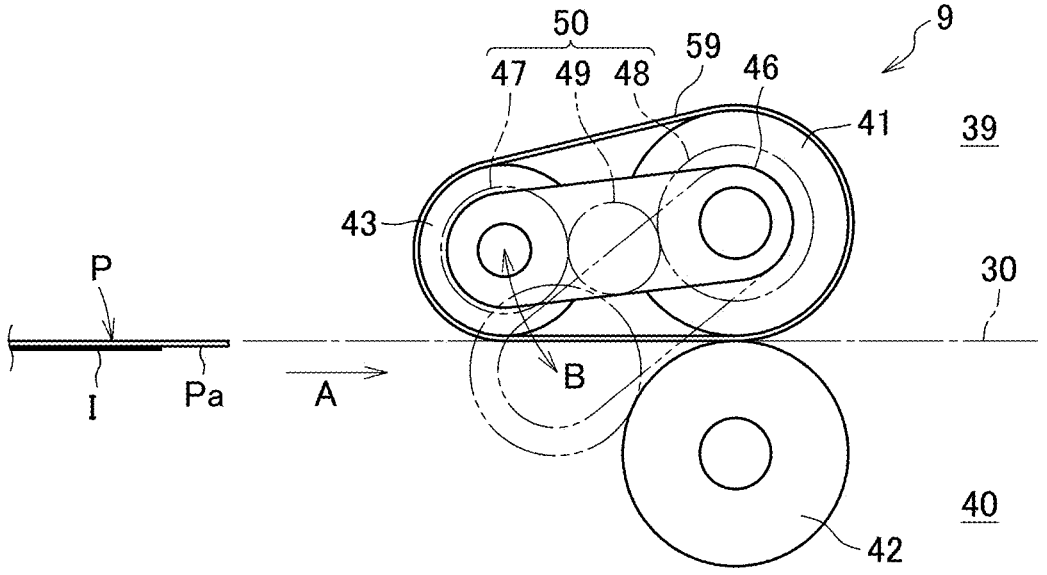
FIG. 21 is a diagram illustrating an example in which a belt is wound around the first ejection roller and the movable roller.

FIG. 21 is a diagram illustrating an example in which a belt is wound around the first ejection roller and the movable roller.

Figure 22:
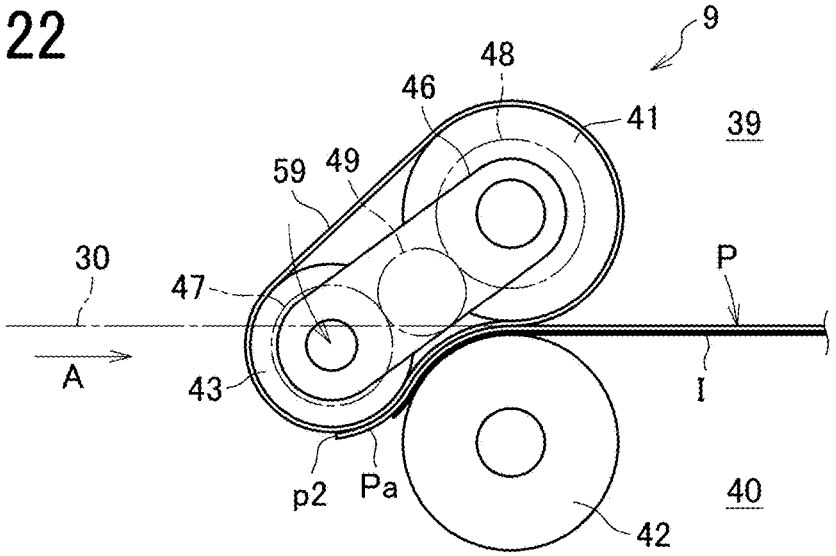
FIG. 22 is a diagram illustrating a state in which the movable roller is moved toward the second ejection roller.

FIG. 22 is a diagram illustrating a state in which the movable roller is moved toward the second ejection roller.

As the example illustrated in FIG. 21, a belt 59 having an endless loop may be wound around the first ejection roller 41 and the movable roller 43. In this case, when the movable roller 43 approaches the second ejection roller 42, as illustrated in FIG. 22, the sheet P is pressed against the second ejection roller 42 by the upstream side of the belt 59 in the sheet conveyance direction. As described above, by pressing the sheet P against the second ejection roller 42 by the belt 59, fluttering of the trailing end p2 of the sheet P is restrained, and the sheet P is caused to closely contact the outer circumferential surface of the second ejection roller 42. Accordingly, the sheet P is warped along the outer circumferential surface of the second ejection roller 42 in the opposite direction opposite the direction of the back curl, and therefore the back curl is effectively decurled. By contrast, in a case in which the configuration without the belt 59, as the embodiment illustrated in FIG. 2, the contact (pressing) of the sheet P against the second ejection roller 42 is restrained, so that application of ink to the second ejection roller 42 and ink smear on the sheet P is reduced. Further, as the example illustrated in FIG. 21, if one of the first ejection roller 41 and the movable roller 43 is driven to rotate, the belt 59 rotates, and the other of the first ejection roller 41 and the movable roller 43 also rotates. Therefore, the gear train 50 may be omitted, and the belt 59 may be used as a power transmission member for transmitting a driving force between the first ejection roller 41 and the movable roller 43.

Figure 23:
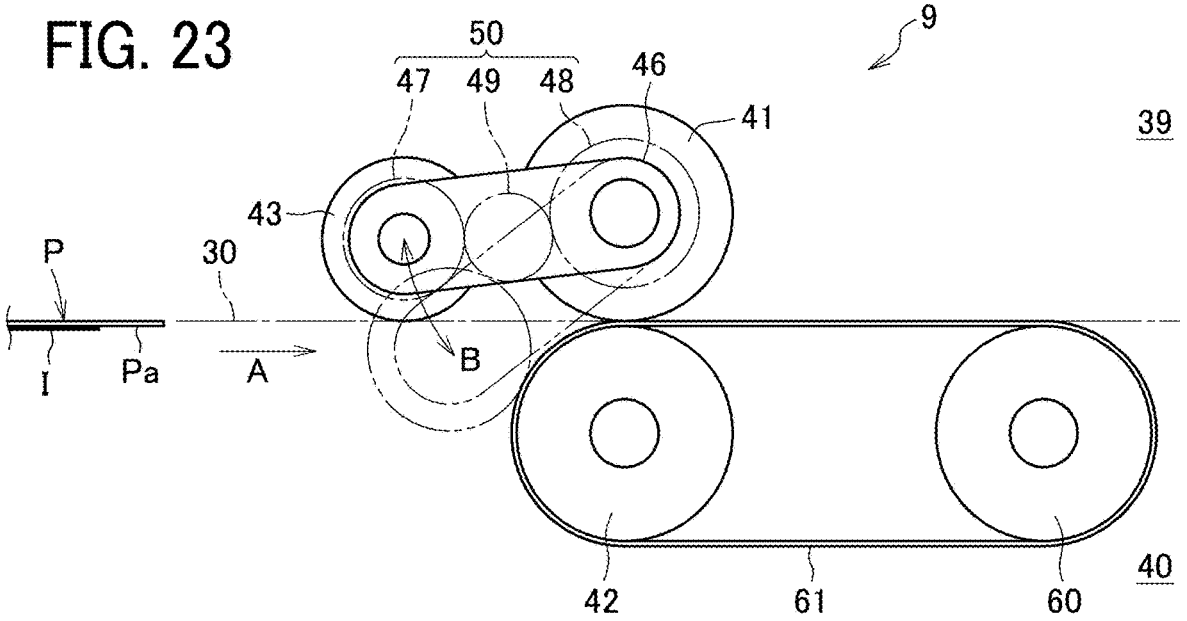
FIG. 23 is a diagram illustrating an example in which a belt is wound around the second ejection roller and the downstream roller.

FIG. 23 is a diagram illustrating an example in which a belt is wound around the second ejection roller and the downstream roller.

As the example illustrated in FIG. 23, the roller 60 may be disposed downstream from the second ejection roller 42 in the sheet conveyance direction A and the belt 61 of an endless loop may be wound around the roller 60 and the second ejection roller 42. In this case, since at least one of the first ejection roller 41 and the second ejection roller 42 rotates, the belt 61 is rotated along with the rotation of the second ejection roller 42. Consequently, the sheet P is conveyed and ejected by the belt 61 while the belt 61 is rotating.

Figure 24:
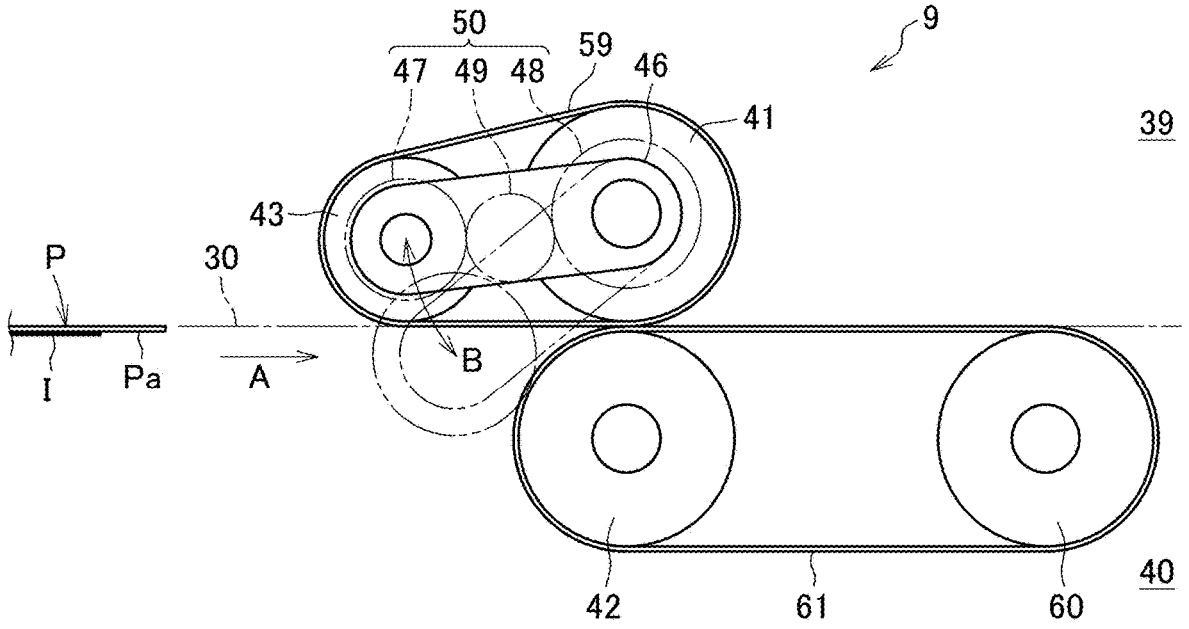
FIG. 24 is a diagram illustrating an example in which the sheet ejection device includes two belts.

FIG. 24 is a diagram illustrating an example in which the sheet ejection device includes two belts.

The example illustrated in FIG. 24 includes the example illustrated in FIG. 21 and the example illustrated in FIG. 23. That is, in the example illustrated in FIG. 24, a belt 59 is wound around the first ejection roller 41 and the movable roller 43 and a belt 61 is wound around the second ejection roller 42 and the roller 60 disposed downstream from the second ejection roller 42 in the sheet conveyance direction. As the configuration of FIG. 24, two belts, which are the belts 59 and 61, may be used to convey the sheet.

Figure 25:
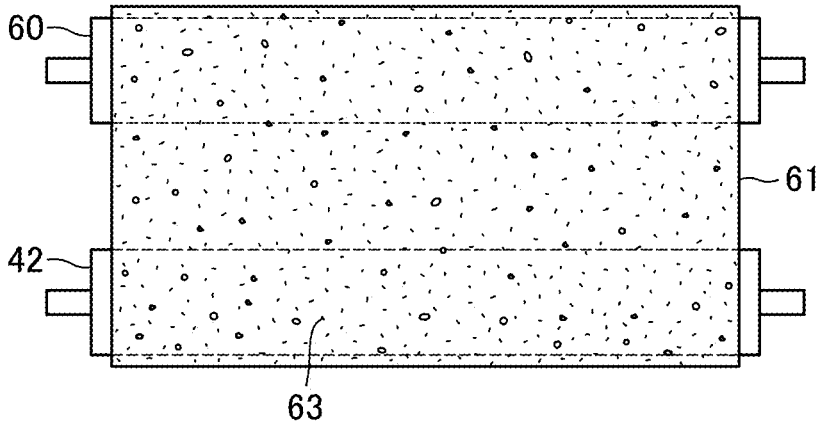
FIG. 25 is a diagram illustrating an example that the outer circumferential surface of a belt has fine surface asperities.

FIG. 25 is a diagram illustrating an example that the outer circumferential surface of the pre a pressing belt has fine surface asperities.

Figure 26:
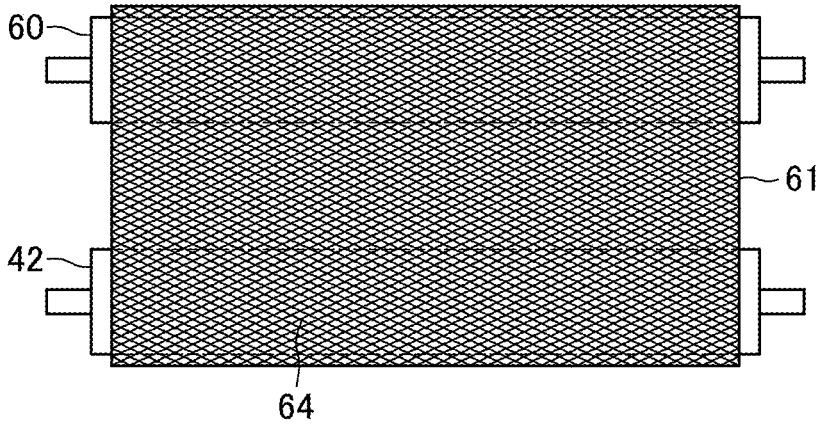
FIG. 26 is a diagram illustrating an example that a belt has a mesh pattern.

FIG. 26 is a diagram illustrating an example that the pressing belt has a mesh pattern.

As described above, the belt 61 is wound around the second ejection roller 42 and the roller 60 disposed downstream from the second ejection roller 42 in the sheet conveyance direction. The belt 61 may be a belt 63 having the uneven outer circumferential surface, in other words, having fine asperities on the outer circumferential surface, as illustrated in FIG. 25, or a belt 64 having a mesh pattern, as illustrated in FIG. 26. As a result, the contact area of the belt 61 to the liquid applied face of the sheet is reduced, so that ink application to the belt 61 and ink smear on the sheet may be reduced.

Figure 27:
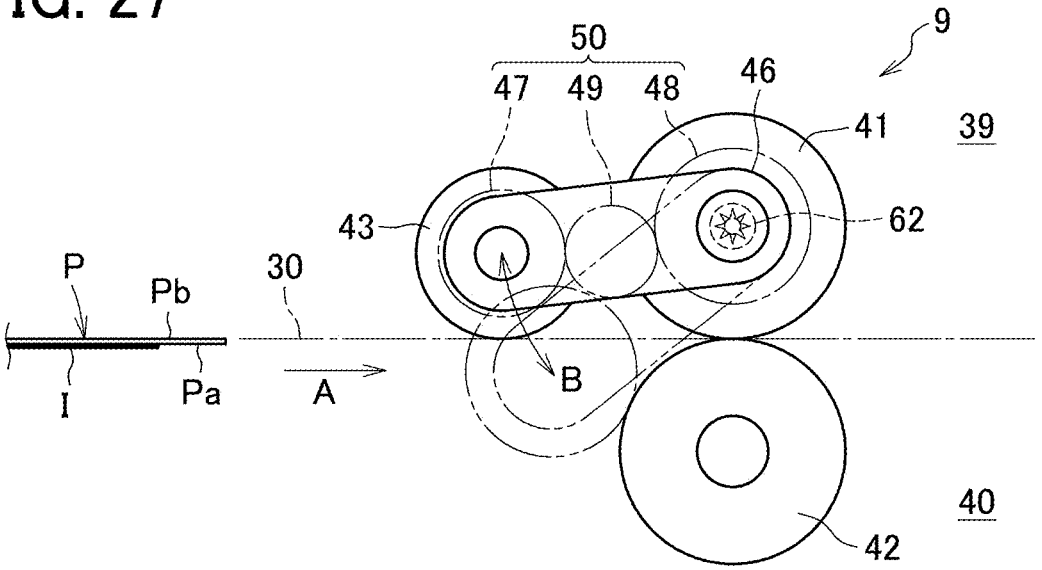
FIG. 27 is a diagram illustrating an example of the arrangement in which a heater is disposed inside the first ejection roller.

FIG. 27 is a diagram illustrating an example of the arrangement in which a heater is disposed inside the first ejection roller.

As illustrated in FIG. 27, a heater 62 that functions as a heat source may be disposed inside the first ejection roller 41. The heater 62 that is disposed inside the first ejection roller 41 may be a radiant-heat-type heater that emits infrared rays such as a halogen heater or a carbon heater. Further, as a heat source to heat the first ejection roller 41, an electromagnetic induction-type heat source and a warm air generation device may be employed. Further, the heater may be a contact-type heater or a non-contact type heater.

In this state, as illustrated in FIG. 27, the first ejection roller 41 is heated by heat generation of the heater 62. Therefore, as the sheet P is conveyed to the sheet ejection device 9, the opposite face Pb that is opposite the liquid applied face Pa of the sheet P contacts the first ejection roller 41, and therefore the sheet P is heated from the opposite face Pb of the sheet P. That is, on the contrary to the example of a back curl illustrated in FIG. 5, the sheet P is heated from the opposite face that is opposite the image forming face of the sheet P. By so doing, the opposite face Pb of the sheet P is heated at the temperature higher than the temperature of the liquid applied face Pa of the sheet P. Therefore, a force is exerted in the opposite direction to a force applied to the sheet P to generate the back curl. As described above, in the sheet ejection device 9 according to the present embodiment illustrated in FIG. 27, the opposite face Pb that is opposite the liquid applied face Pa is heated at the temperature higher than the liquid applied face Pa of the sheet P. By so doing, the force is generated in the opposite direction to the force to generate the back curl, thereby restraining generation of the subsequent back curl more effectively.

Figure 28:
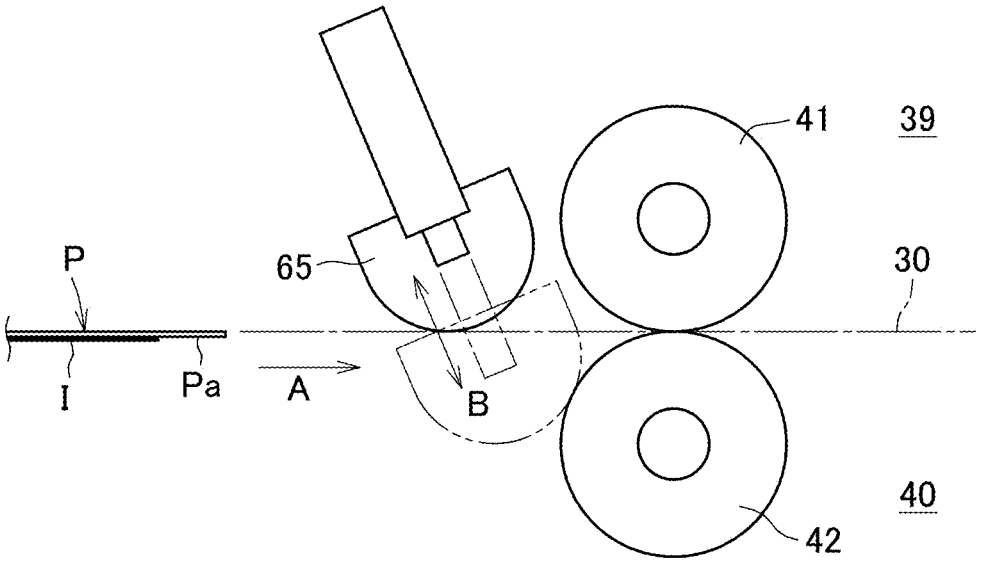
FIG. 28 is a diagram illustrating an example that a moving member that does not rotate is employed.

FIG. 28 is a diagram illustrating an example that a movable member that does not rotate is employed.

As the example illustrated in FIG. 28, the movable member 65 that moves to approach or separate from the second ejection roller 42 may not be a rotary body such as the movable roller 43 but may be a member that does not rotate. Further, as illustrated in FIG. 28, the moving direction B of the movable member 65 may be a linear shape instead of an arc shape centered on the first ejection roller 41.

Figure 29:
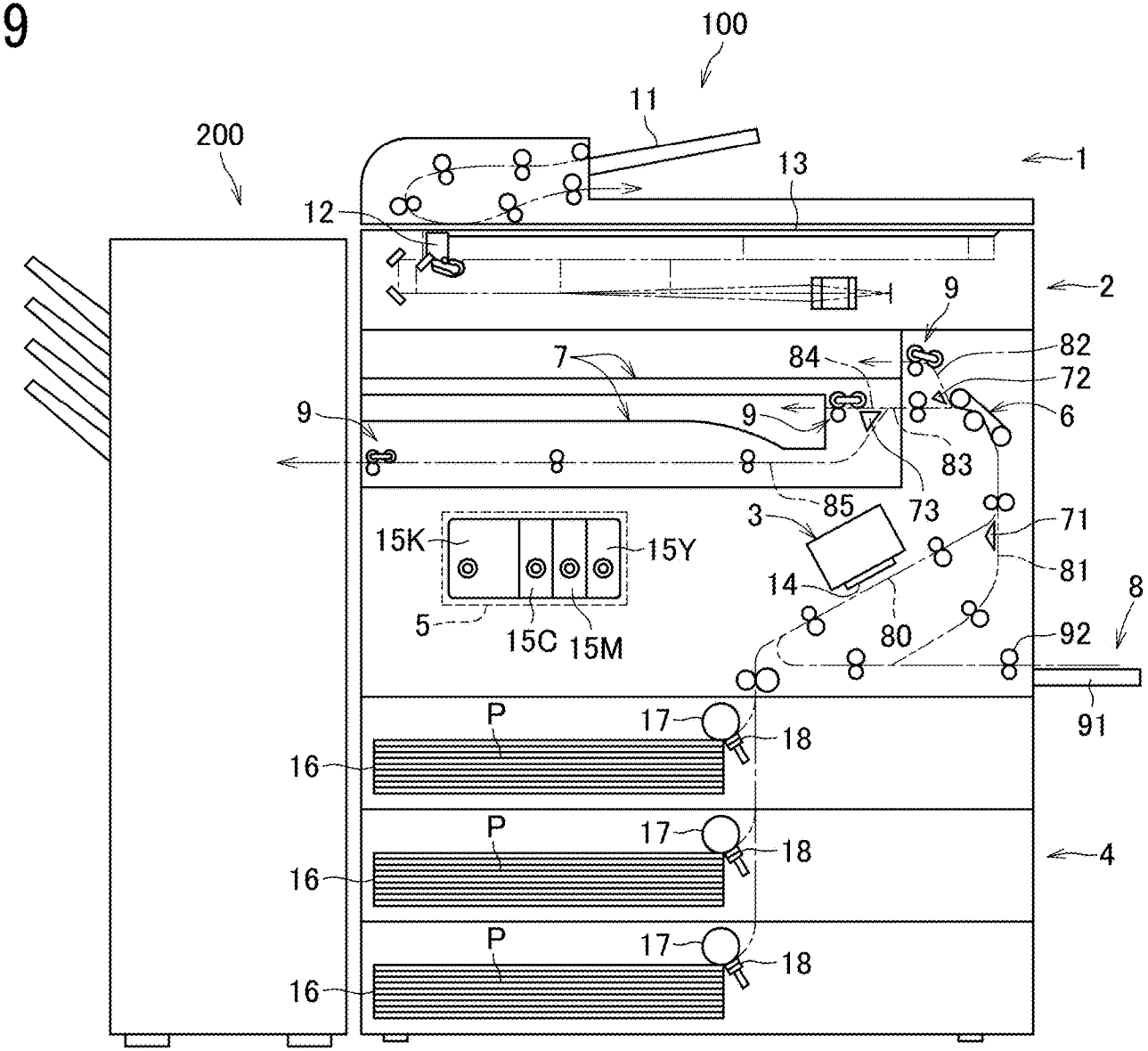
FIG. 29 is a diagram illustrating an example that the sheet ejection device according to the present disclosure is provided in another image forming apparatus.
Figure 30:
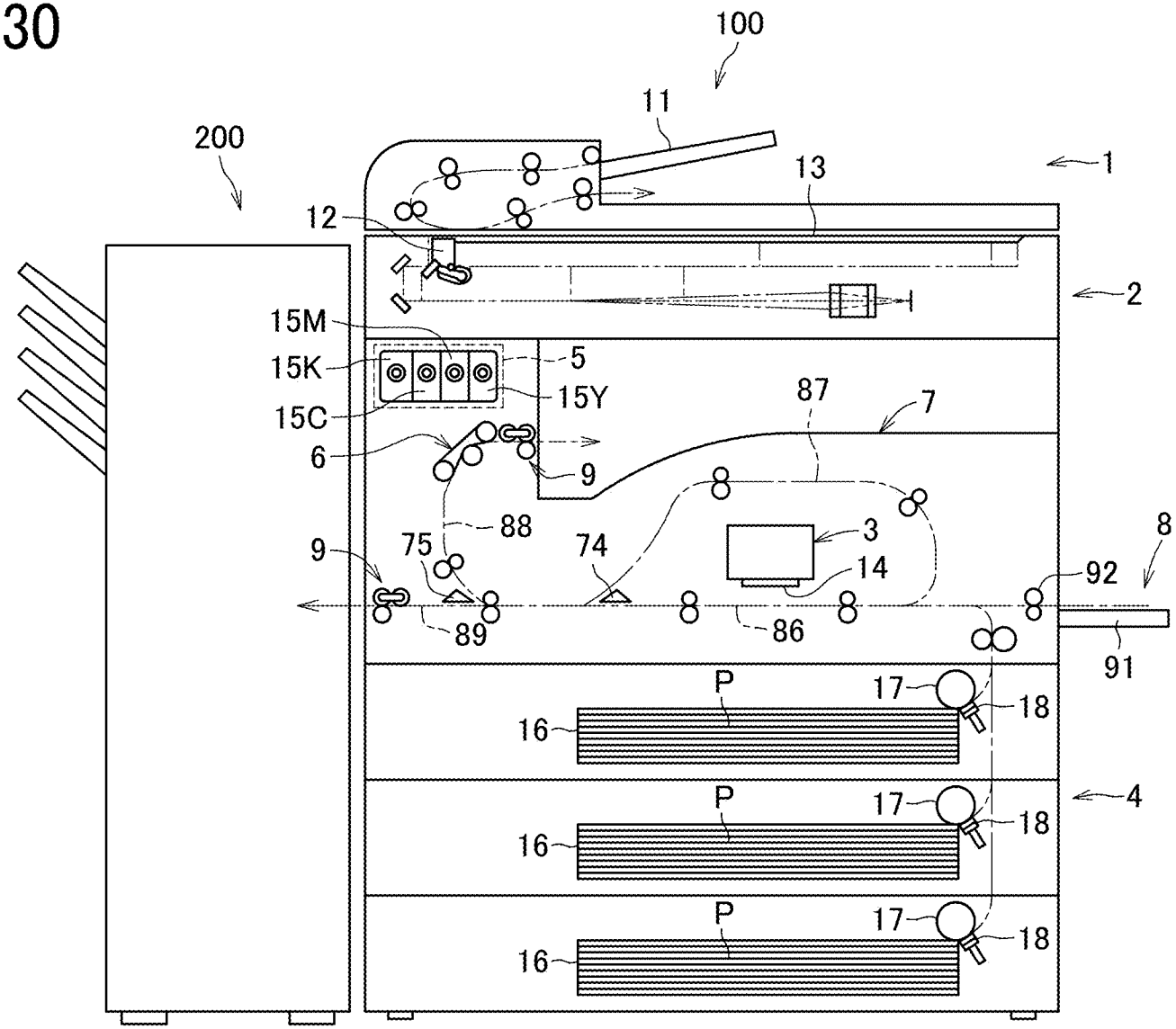
FIG. 30 is a diagram illustrating an example that the sheet ejection device according to the present disclosure is provided in yet another image forming apparatus.

Further, the sheet ejection device according to the present disclosure is not limited to the image forming apparatus having the configuration as illustrated in FIG. 1 but may be applied, for example, to the image forming apparatus having the configuration as illustrated in FIG. 29 or FIG. 30.

Next, a description is given of the configuration of the image forming apparatus 100 with reference to FIGS. 29 and 30.

FIG. 29 is a diagram illustrating an example that the sheet ejection device (conveying device) according to the present disclosure is provided in another image forming apparatus 100.

FIG. 30 is a diagram illustrating an example that the sheet ejection device (conveying device) according to the present disclosure is provided in yet another image forming apparatus 100.

Note that the following description is given of the configuration of the image forming apparatus 100 of FIGS. 29 and 30 different from the configuration of the image forming apparatus 100 according to the configuration of the image forming apparatus 100 illustrated in FIG. 1. That is, the description of the configuration of the image forming apparatus 100 of FIGS. 29 and 30 that is same as the configuration of the image forming apparatus 100 according to the above-described embodiment, for example, the image forming apparatus 100 illustrated in FIG. 1, may be omitted.

As in the image forming apparatus 100 according to the above-described embodiments, for example, in FIG. 1, the image forming apparatus 100 illustrated in FIG. 29 includes the original document conveying device 1, the image reading device 2, the image forming device 3, the sheet feeding device 4, the cartridge container 5, the drying device 6, the upper and lower sheet ejection portions 7, and the sheet ejection device 9. Different from the image forming apparatus 100 according to the above-described embodiments (FIG. 1), the image forming apparatus 100 illustrated in FIG. 29 further includes a bypass sheet feeding device 8. The sheet ejection device 9 is provided near an ejection port through which the sheet is ejected to the upper sheet ejection portion 7, near an ejection port through which the sheet is ejected to the lower sheet ejection portion 7, and near an ejection port through which the sheet is transferred to the sheet alignment apparatus 200. Further, different from the image forming device 3 included in the image forming apparatus 100 in FIG. 1, the image forming device 3 included in the image forming apparatus 100 in FIG. 29 is disposed facing a sheet conveyance passage 80 in which the sheet P is conveyed in a direction obliquely to the horizontal direction.

The bypass sheet feeding device 8 includes a bypass tray 91 and a bypass sheet feed roller 92. The bypass tray 91 functions as a sheet loader to load the sheet P. The bypass sheet feed roller 92 functions as a sheet feed body to feed the sheet P from the bypass tray 91. The bypass tray 91 is attached to open and close with respect to the housing of the image forming apparatus 100. In other words, the bypass tray 91 is rotatably attached to the housing of the image forming apparatus 100. When the bypass tray 91 is open (state in FIG. 29), the sheet P or the bundle of sheets including the sheet P is loaded on the bypass tray 91 to feed the sheet P to the housing of the image forming apparatus 100.

In the image forming apparatus 100 illustrated in FIG. 29, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the drying device 6 in the sheet conveyance direction, and the sheet P may be guided to the image forming device 3 again via the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected by the sheet ejection device 9 to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the sheet alignment apparatus 200.

In a case in which the sheet P is guided to the sheet conveyance passage 84 toward the lower sheet ejection portion 7, the sheet P is ejected by another sheet ejection device 9 to the lower sheet ejection portion 7. On the other hand, when the sheet P is guided to the sheet conveyance passage 85 toward the sheet alignment apparatus 200, the sheet P is conveyed by yet another sheet ejection device 9 to the sheet alignment apparatus 200. Then, the sheet P is conveyed to the sheet alignment apparatus 200, so that the bundle of sheets P is aligned and stacked.

Similar to the image forming apparatus 100 illustrated in FIG. 29, the image forming apparatus 100 illustrated in FIG. 30 includes the original document conveying device 1, the image reading device 2, the image forming device 3, the sheet feeding device 4, the cartridge container 5, the drying device (heating device) 6, the sheet ejection portion 7, the sheet ejection device 9, and the bypass sheet feeding device 8. The sheet ejection device 9 is provided near an ejection port through which the sheet is ejected to the sheet ejection portion 7 and near an ejection port through which the sheet is transferred to the sheet alignment apparatus 200. Note that, in this case, similar to the image forming device 3 included in the image forming apparatus 100 in FIG. 1, the image forming device 3 included in the image forming apparatus 100 illustrated in FIG. 30 is disposed facing a sheet conveyance passage 86 in which the sheet P is conveyed in the horizontal direction.

In the image forming apparatus 100 illustrated in FIG. 30, as a print job start instruction is issued, the sheet P is supplied from the sheet feeding device 4 or from the bypass sheet feeding device 8 and is conveyed to the image forming device 3. When the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

After an image is formed on one side or both sides of the sheet P, a second passage changer 75 guides the sheet P selectively to a sheet conveyance passage 88 that runs toward the drying device 6 or to a sheet conveyance passage 89 that runs to the sheet alignment apparatus 200. When the sheet P is guided to the sheet conveyance passage 88 toward the drying device 6, the drying device 6 dries the ink on the sheet P. Note that, when drying the ink on the front face of the sheet P and then forming an image on the back face of the sheet P, the drying device 6 may dry the ink on the front face of the sheet P first, and then, the sheet P may be conveyed in a sheet conveyance passage that detours the drying device 6. Then, the direction of conveyance of the sheet P may be switched back (changed) to the upstream side from the sheet conveyance passage 88 (upstream sides from the drying device 6) in the sheet conveyance direction, and the sheet P may be guided to the image forming device 3 again via the sheet reverse passage 87. Consequently, the sheet P that has passed the drying device 6 is ejected to the sheet ejection portion 7 by the sheet ejection device 9. On the other hand, when the sheet P is guided to the sheet conveyance passage 89 toward the sheet alignment apparatus 200, the sheet P is ejected by another sheet ejection device 9 to the sheet alignment apparatus 200. Then, the sheet P is conveyed to the sheet alignment apparatus 200, so that the bundle of sheets P is aligned and stacked.

As the sheet ejection device 9 provided to the image forming apparatus 100 as illustrated in FIGS. 29 and 30, the sheet ejection device according to the present disclosure is applied to achieve the same effect as in the configuration of the image forming apparatus 100 illustrated in FIG. 1. That is, in a case in which the sheet has a portion having a back curl, a decurling operation is mainly performed on the portion of the sheet to decurl the back curl. On the other hand, the decurling operation is hardly performed on the sheet other than the portion having the back curl, so that generation of a curl due to the decurling operation is restrained.

Figure 31:
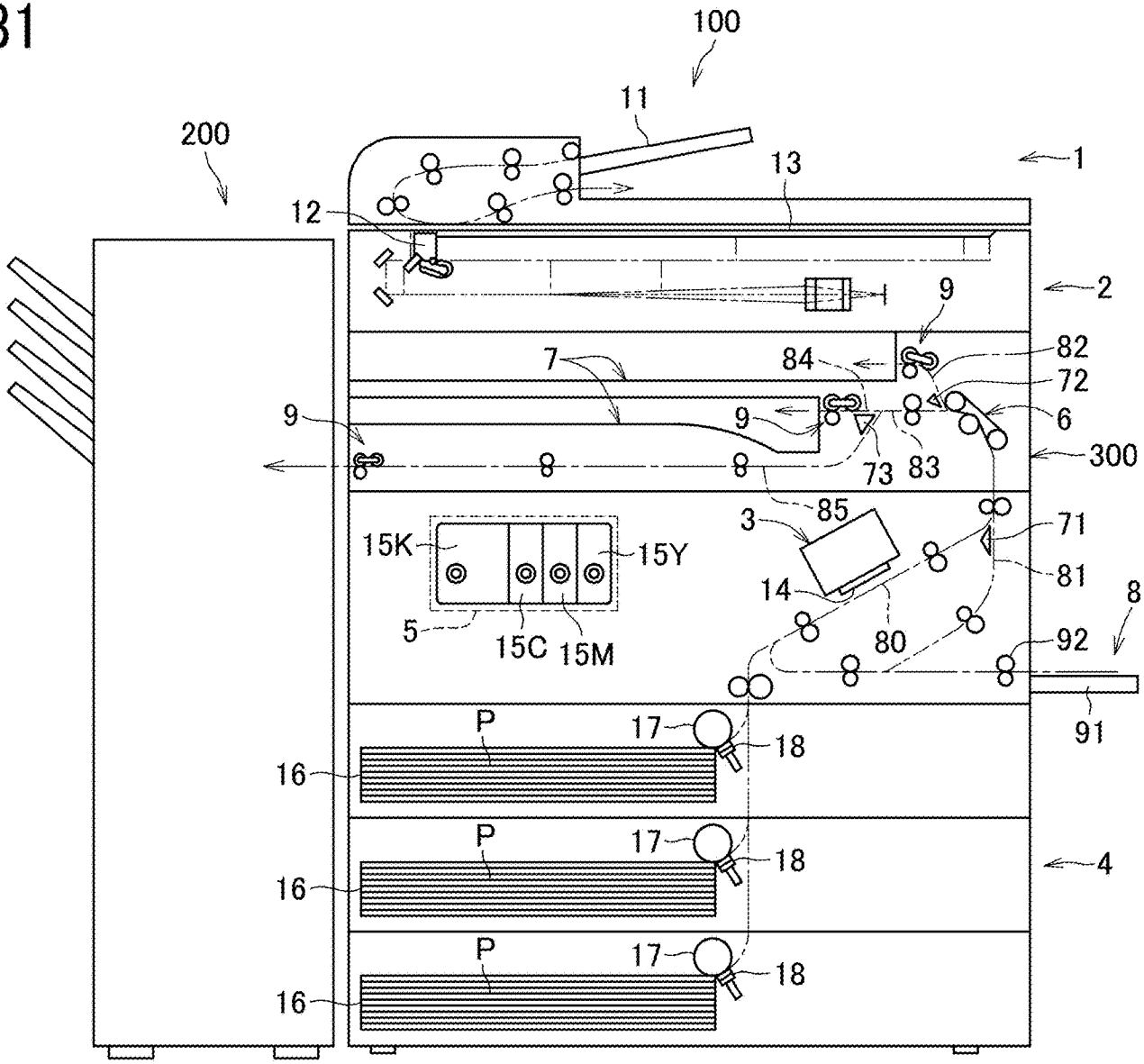
FIG. 31 is a diagram illustrating an example that the configuration according to the present disclosure is applied to a unit that is detachably attachable to the housing of the image forming apparatus.

FIG. 31 is a diagram illustrating an example that the conveying device according to the present disclosure is provided in a unit that is detachably attachable to the housing of the image forming apparatus 100.

The sheet ejection device 9 illustrated in FIG. 31 is provided in a unit 300 between the image reading device 2 and the image forming device 3. Further, the sheet ejection device 9 partially includes a sheet conveyance passage 85 that conveys a sheet on which an image is formed to a post-processing device (for example, a sheet alignment apparatus 200). Even in the sheet ejection device 9 included in the unit 300, as the configuration according to the present disclosure is provided to the sheet ejection device 9, even if deformation of the sheet such as a curl is generated in the image forming apparatus 100, the sheet ejection device 9 provided in the unit 300 restrains the deformation of the sheet effectively.

Figure 32:
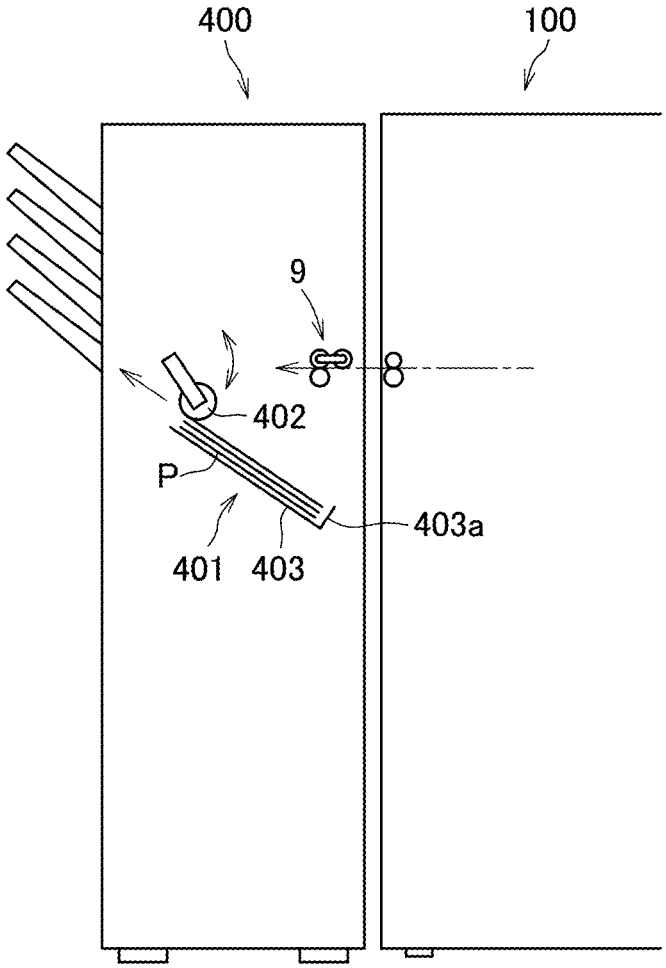
FIG. 32 is a diagram illustrating an example that the sheet ejection device according to the present disclosure is provided in a post-processing apparatus.

Further, FIG. 32 is a diagram illustrating an example that the sheet ejection device according to the present disclosure is provided in a post-processing apparatus.

The configuration of the sheet ejection device 9 (conveying device) according to the present disclosure is applicable to a post-processing apparatus 400 as illustrated in FIG. 32. The post-processing apparatus 400 includes the sheet ejection device 9 that ejects the sheet to the sheet stacking tray 403 and a post-processing device 401 that performs a stapling process and a punching process to the sheet.

As the sheet is conveyed from the image forming apparatus 100 to the post-processing apparatus 400 illustrated in FIG. 24, the sheet is conveyed by the sheet ejection device 9 and is loaded on a sheet stacking tray 403 of the post-processing device 401. At this time, in a case in which the sheet is stacked in the sheet stacking tray 403 with the face up (with the image forming surface facing up), the order of image formation may be set to be reversed, in other words, the image may be formed from the last page first. Further, the sheet P stacked on the sheet stacking tray 403 is conveyed by the sheet conveying roller 402 provided in the post-processing device 401 in the reverse direction with the trailing end to the leading end. By so doing, the trailing end of the sheet P contacts a trailing end regulator 403*a* of the sheet stacking tray 403, so that the position of the trailing end of the sheet P is aligned. Further, in order not to hinder ejection of the sheet to the sheet stacking tray 403, the sheet conveying roller 402 is disposed to be movable from a position at which the sheet conveying roller 402 contacts the sheet P to a retreat position at which the sheet conveying roller 402 does not contact the sheet P. In the state in which the position of the trailing end of the sheet P is aligned, the stapling process and the punching process are performed to the sheet P. Thereafter, the sheet conveying roller 402 rotates in the reverse direction, and therefore the sheet P on the sheet stacking tray 403 is ejected to the outside of the post-processing apparatus 400. Even in the sheet ejection device 9 included in the post-processing apparatus 400, as the configuration according to the present disclosure is provided to the sheet ejection device 9, even if deformation of the sheet such as a curl is generated in the image forming apparatus 100, the sheet ejection device 9 provided in the post-processing apparatus 400 restrains the deformation of the sheet effectively.

In addition, the configuration according to an embodiment of the present disclosure is not limited to a case in which the configuration is applied to a sheet ejection device (conveying device) that ejects the sheet to the outside of the apparatus. The configuration according to the present disclosure is also applied to a conveying device that conveys the sheet in the middle of a sheet conveyance passage from the image forming device 3 to the drying device 6 or in a sheet reverse passage for reversing the front and back of the sheet P and conveying the sheet P to the image forming device 3.

Further, in addition to the image forming apparatus, the conveying device according to the present disclosure may be applied to a liquid applying apparatus that applies liquid that does not form an image on a sheet.

Figure 33:
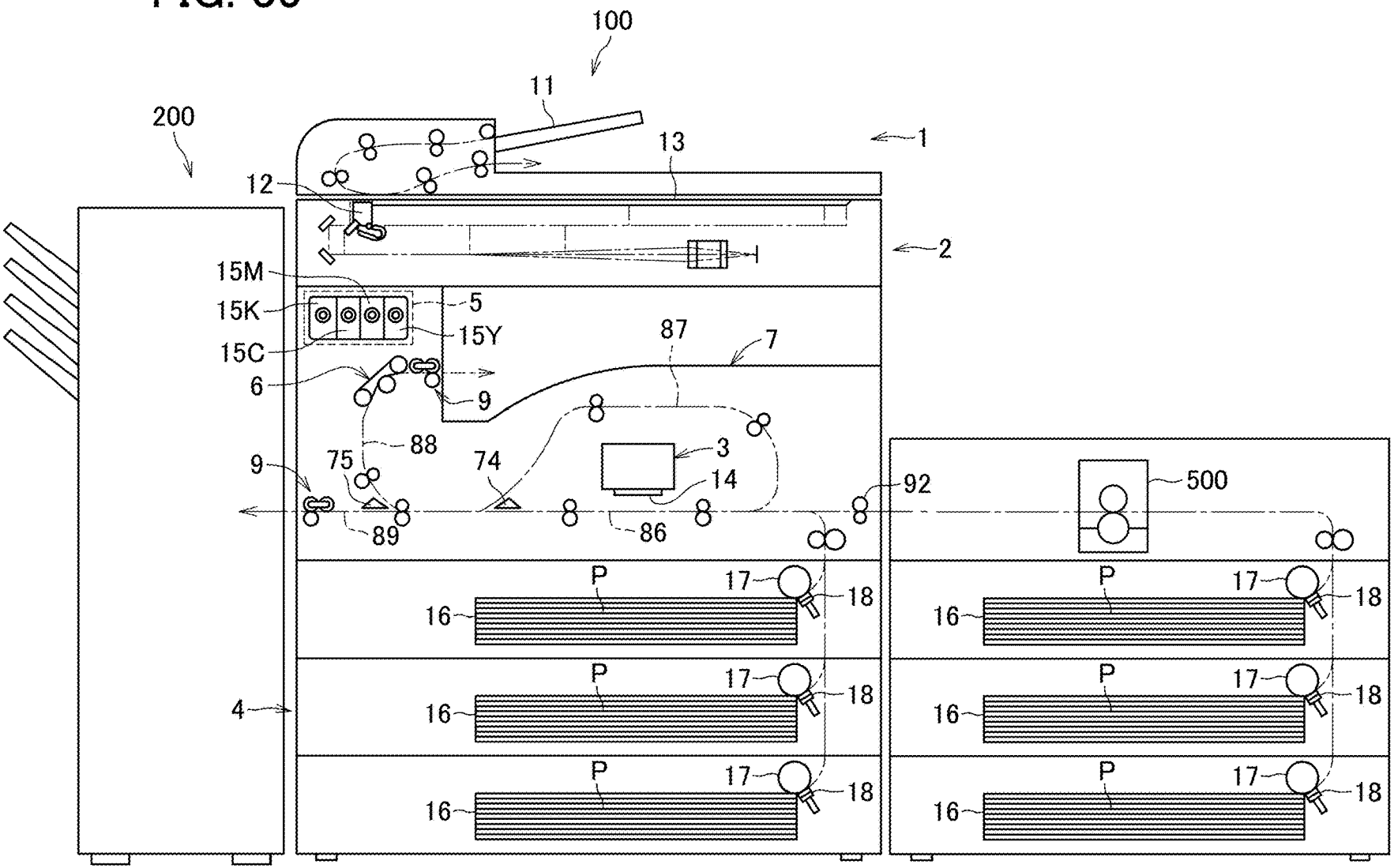
FIG. 33 is a diagram illustrating an example that the sheet ejection device according to the present disclosure is provided in a liquid applying apparatus.

For example, FIG. 33 is a diagram illustrating an example that the sheet ejection device (conveying device) 9 according to the present disclosure is provided in a liquid applying apparatus 1000.

That is, the sheet ejection device (conveying device) 9 according to the present disclosure may be applied to the liquid applying apparatus 1000. The liquid applying apparatus 1000 includes an inkjet image forming apparatus 100 that discharges ink to form an image on the sheet and a processing liquid applier 500 that discharges or applies a processing liquid on the surface of the sheet, as illustrated in FIG. 33, for the purpose of modifying and enhancing the surface of the sheet. Note that the processing liquid applier 500 illustrated in FIG. 33 applies a processing liquid onto the surface of the sheet P, then the liquid discharge head 14 discharges ink to apply the ink on the surface of the sheet P, and the drying device 6 dries the sheet P. However, the operation flow is not limited to the above-described flow. For example, the processing liquid applier 500 may apply a processing liquid onto the surface of the sheet P, then the drying device 6 may dry the sheet P, and the sheet may be conveyed to the sheet feed roller 92.

Further, the conveying device according to the present disclosure is not limited to the configuration to restrain generation of a back curl but is applicable to a configuration to restrain a face curl. For example, as the configuration example illustrated in FIG. 2, the first ejection roller 41 and the movable roller 43 may be disposed in the second region 40 that is the side of the liquid applied face Pa of the sheet P and the second ejection roller 42 may be disposed in the first region 39 that is the opposite side of the liquid applied face Pa of the sheet P. In this case, the movable roller 43 is moved from the second region 40 to the first region 39 in the middle of passage of the sheet P between the first ejection roller 41 and the second ejection roller 42. By so doing, the movable roller 43 causes trailing end p2 of the sheet P to be pressed against the second ejection roller 42 to warp the sheet in a direction opposite the curling direction of the face curl. Accordingly, generation of the face curl on the trailing end p2 of the sheet P is restrained.

Further, the sheet to be heated by the conveying device according to the present disclosure may be paper or any other material. For example, as long as the sheet has flexibility and is conveyable while being warped, the sheet may be paper sheet, resin, metal, cloth, or leather.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A conveying device comprising:

a pair of rotary bodies including:

a first rotary body disposed in a first region; and a second rotary body disposed in a second region and facing the first rotary body across a sheet conveyance passage through which a sheet applied with liquid is conveyed;

a movable rotary body disposed upstream from the first rotary body in a sheet conveyance direction, the movable rotary body to move between the first region and the second region with respect to the sheet conveyance passage;

a sensor to detect the sheet; and processing circuitry configured to move the movable rotary body to the second region in a middle of conveyance of the sheet between the first rotary body and the second rotary body, in response to the sensor detecting a trailing end of the sheet.

2. The conveying device according to claim 1, wherein the processing circuitry is configured to move the movable rotary body to the second region after an intermediate position of the sheet in the sheet conveyance direction has passed the pair of rotary bodies.

3. The conveying device according to claim 1, wherein an amount of approach of the movable rotary body to the second region is adjustable.

4. The conveying device according to claim 1, wherein, when either a liquid applied area rate or an amount of liquid application on one face of the sheet is equal to or smaller than an opposite face of the sheet, an amount of movement of the movable rotary body to the second region is reduced or the movable rotary body is not caused to move to the second region.

5. The conveying device according to claim 1, wherein, when a thickness of the sheet is equal to or greater than a predetermined thickness of the sheet, an amount of movement of the movable rotary body to the second region is reduced or the movable rotary body is not caused to move to the second region.

6. The conveying device according to claim 1, further comprising a coupler to couple the movable rotary body and the first rotary body, wherein the movable rotary body is rotatably supported via the coupler to rotate about the first rotary body, and wherein the movable rotary body is to move between the first region and the second region.

7. The conveying device according to claim 1, wherein the movable rotary body is to approach or separate from the second rotary body.

8. The conveying device according to claim 1, wherein the movable rotary body is configured to approach the second rotary body to enter radially inwardly from a position of an outer circumferential surface of the second rotary body.

9. The conveying device according to claim 1, further comprising:

a power transmitter via which the first rotary body and the movable rotary body are coupled to each other, wherein the movable rotary body is to rotate along with rotation of the first rotary body in a same direction as the first rotary body.

10. The conveying device according to claim 1, wherein the second rotary body is a projecting rotary body having a plurality of projections projecting radially outwardly.

11. The conveying device according to claim 1, further comprising a conveyance passage to convey a sheet to a post-processing device to perform a post-processing operation to the sheet.

12. A liquid applying apparatus comprising:

a liquid applier to apply liquid to a sheet; and the conveying device according to claim 1.

13. An image forming apparatus comprising:

an image forming device to form an image on a sheet with liquid; and the conveying device according to claim 1.

14. A post-processing apparatus comprising:

the conveying device according to claim 1; and a post-processing device to perform a post-processing operation to a sheet.

15. A conveying device comprising:

a pair of rotary bodies including:

a first rotary body disposed in a first region; and a second rotary body disposed in a second region and facing the first rotary body across a sheet conveyance passage through which a sheet applied with liquid is conveyed;

a movable rotary body to contact an upstream side of the sheet from the pair of rotary bodies in a sheet conveyance direction while the sheet is held by the pair of rotary bodies;

a sensor to detect the sheet; and processing circuitry configured to move the movable rotary body to change a position of the movable rotary body, in response to an output of the sensor.

16. The conveying device according to claim 15, further comprising a conveyance passage to convey a sheet to a post-processing device to perform a post-processing operation to the sheet.

17. A liquid applying apparatus comprising:

a liquid applier to apply liquid to a sheet; and the conveying device according to claim 15.

18. An image forming apparatus comprising:

an image forming device to form an image on a sheet with liquid; and the conveying device according to claim 15.

19. A post-processing apparatus comprising:

the conveying device according to claim 15; and a post-processing device to perform a post-processing operation to a sheet.

20. A conveying device comprising:

a pair of rotary bodies including:

a first rotary body disposed in a first region; and a second rotary body disposed in a second region and facing the first rotary body across a sheet conveyance passage through which a sheet applied with liquid is conveyed; and a movable rotary body disposed upstream from the first rotary body in a sheet conveyance direction, the movable rotary body to move between the first region and the second region with respect to the sheet conveyance passage, the movable rotary body to move to the second region in a middle of conveyance of the sheet between the first rotary body and the second rotary body, wherein, when either a liquid applied area rate or an amount of liquid application on one face of the sheet is equal to or smaller than an opposite face of the sheet, an amount of movement of the movable rotary body to the second region is reduced or the movable rotary body is not caused to move to the second region.

* * * * *